US006991562B2

(12) United States Patent
Sullivan et al.

(10) Patent No.: US 6,991,562 B2
(45) Date of Patent: Jan. 31, 2006

(54) GOLF BALL WITH SOFT CORE

(75) Inventors: Michael J. Sullivan, Barrington, RI (US); Thomas J. Kennedy, Wilbraham, MA (US); John L. Nealon, Springfield, MA (US); Kevin J. Shannon, Longmeadow, MA (US)

(73) Assignee: Callaway Golf Company, Carlsbad, CA (US)

( * ) Notice: Subject to any disclaimer, the term of this patent is extended or adjusted under 35 U.S.C. 154(b) by 362 days.

(21) Appl. No.: 10/077,148

(22) Filed: Feb. 15, 2002

(65) Prior Publication Data

US 2002/0119835 A1 Aug. 29, 2002

Related U.S. Application Data

(60) Continuation of application No. 09/724,156, filed on Nov. 28, 2000, now Pat. No. 6,425,833, which is a continuation of application No. 09/299,416, filed on Apr. 26, 1999, now Pat. No. 6,152,835, which is a division of application No. 08/975,799, filed on Nov. 21, 1997, now Pat. No. 5,971,870.

(51) Int. Cl.
*A63B 37/06* (2006.01)

(52) U.S. Cl. ..... 473/373

(58) Field of Classification Search ..... 473/351, 473/367, 368, 370, 371, 374, 376, 377, 378
See application file for complete search history.

(56) References Cited

U.S. PATENT DOCUMENTS 4,919,434 A * 4/1990 Saito ..... 473/373
5,314,187 A * 5/1994 Proudfit ..... 473/373
5,368,304 A * 11/1994 Sullivan et al. ..... 473/377
5,779,563 A * 7/1998 Yamagishi et al. ..... 473/371
5,971,870 A * 10/1999 Sullivan et al. ..... 473/373

* cited by examiner

*Primary Examiner*—Raeann Gorden
(74) *Attorney, Agent, or Firm*—Michael A. Catania; Elaine H. Lo

(57) ABSTRACT

Disclosed herein is a golf ball with a solid core having a PGA compression of 55 or less and an outer cover layer having a Shore D hardness of at least 60, the ball having a PGA compression of 80 or less. In another embodiment of the invention, the ball has a mechanical impedance with a primary minimum value in a frequency range of 3100 Hz or less after the ball has been maintained at 21.1° C., 1 atm. and about 50% relative humidity for at least 15 hours. A further embodiment of the invention is a golf ball having a core, and a cover with a Shore D hardness of at least 58, the ball having a mechanical impedance with a primary minimum value in the frequency range of 2600 Hz after the ball has been maintained at 21.1° C., 1 atm. and about 50% relative humidity for at least 15 hours. The balls of the invention have good distance while providing a soft sound and feel.

18 Claims, 13 Drawing Sheets

GOLF BALL WITH SOFT CORE

CROSS REFERENCES TO RELATED APPLICATIONS

The present application is a continuation application of U.S. Ser. No. 09/724,156, which was filed on Nov. 28, 2000 now U.S. Pat. No. 6,425,833, which is a continuation of U.S. Ser. No. 09/299,416, which was filed on Apr. 26, 1999, and issued on Nov. 28, 2000 as U.S. Pat. No. 6,152,835. That application, in turn, is a divisional application of U.S. Ser. No. 08/975,799, which was filed on Nov. 21, 1997 and issued on Oct. 26, 1999 as U.S. Pat. No. 5,971,870.

FIELD OF THE INVENTION

The present invention relates to golf balls and more particularly to golf balls having a soft core.

BACKGROUND OF THE INVENTION

The spin rate and "feel" of a golf ball are particularly important aspects to consider when selecting a golf ball for play. A golf ball with the capacity to obtain a high rate of spin allows a skilled golfer the opportunity to maximize control over the ball. This is particularly beneficial when hitting a shot on an approach to the green.

Golfers have traditionally judged the softness of a ball by the sound of the ball as it is hit with a club. Soft golf balls tend to have a low frequency sound when struck with a club. This sound is associated with a soft feel and thus is desirable to a skilled golfer.

Balata covered wound golf balls are known for their soft feel and high spin rate potential. However, balata covered balls suffer from the drawback of low durability. Even in normal use, the balata covering can become cut and scuffed, making the ball unsuitable for further play. Furthermore, the coefficient of restitution of wound balls is reduced by low temperatures.

The problems associated with balata covered balls have resulted in the widespread use of durable ionomeric resins as golf ball covers. However, balls made with ionomer resin covers typically have PGA compression ratings in the range of 90–100. Those familiar with golf ball technology and manufacture will recognize that golf balls with PGA compression ratings in this range are considered to be somewhat harder than conventional balata covered balls. It would be useful to develop a golf ball having a durable cover which has the sound and feel of a balata covered wound ball.

SUMMARY OF THE INVENTION

An object of the invention is to provide a golf ball having a soft feel.

Another object of the invention is to provide a golf ball which will travel a long distance when hit.

A further object of the invention is to provide a golf ball which produces a pleasing, soft sound on impact with a golf club.

A further object of the invention is to provide a golf ball having a combination of soft feel and good travel distance.

Another object of the invention is to provide a golf ball with a cover that is more cut resistant and temperature resistant than balata covers.

A final object of the invention is to provide a method for making a golf ball of the type described herein.

Other objects, features, advantages and characteristics of the invention will be in part obvious and in part pointed out more in detail hereinafter.

The invention in a preferred form is a golf ball comprising a solid core having a PGA compression of 55 or less and an outer cover layer having a Shore D hardness of at least 58, the ball having a PGA compression of 80 or less.

In a particularly preferred form of the invention, the outer cover layer has a Shore D hardness of at least 63. The ball preferably has a PGA compression of 70 or less. In a particularly preferred form of the invention, the diameter of the ball is no more than 1.70 inches.

The ball preferably has a high coefficient restitution of at least 0.780, and more preferably at least 0.790.

The golf ball of the present invention has a soft feel which can be defined as a mechanical impedance with a primary minimum value in the frequency range of 3100 Hertz (Hz) or less after the ball has been maintained at 21.1° C., 1 atm. and about 50% relative humidity for at least 15 hours. Preferably, the mechanical impedance has a primary minimum value in the frequency range of 100–3100 Hz and more preferably 1800–3100 Hz after the ball has been maintained at 21.1° C., 1 atm. and about 50% relative humidity for at least 15 hours. Even more preferably, the ball has a mechanical impedance with a primary minimum value in the frequency range of 1800–2600 Hz after the ball has been maintained at 21.1° C., 1 atm. and about 50% relative humidity for at least 15 hours.

In a preferred form of the invention, the outer cover layer comprises ionomer. Preferably, the outer cover layer contains at least 50 weight % ionomer, and even more preferably at least 70 weight % ionomer. The outer cover layer most preferably contains at least 50 weight % of an ionomeric resin which is formed from an acid copolymer with a melt index of 30 g/10 mins or less prior to neutralization with metal ions, and more preferably 23 g/10 mins or less prior to neutralization (ASTM-D 1238E at 190 Deg. C.).

Another preferred form of the invention is a golf ball comprising a solid core and an outer cover layer having a Shore D hardness of at least 58, the ball having a mechanical impedance with a primary minimum value in the frequency range of 3100 Hz or less after the ball has been maintained at 21.1° C., 1 atm. and about 50% relative humidity for at least 15 hours. In a particularly preferred form of the invention, the core has a PGA compression of 55 or less. The ball preferably has a PGA compression of 80 or less, and preferably has a mechanical impedance with a primary minimum value in the frequency range of 1800–3100 Hz and more preferably 1800–2600. after the ball has been maintained at 21.1° C., 1 atm. and about 50% relative humidity for at least 15 hours.

Yet another preferred form of the invention is a golf ball comprising a solid core having a PGA compression of 55 or less, and an outer cover layer with a Shore D hardness of at least 58, the ball having a mechanical impedance with a primary minimum value in the frequency range of 3100 Hz or less after the ball has been maintained at 21.1° C., 1 atm. and about 50% relative humidity for at least 15 hours. The ball preferably has a PGA compression of 80 or less. The outer cover layer preferably has a Shore D hardness of at least 60 and more preferably at least 65. In a particularly preferred form of the invention, the ball has a coefficient of restitution of at least 0.780. The ball preferably has a mechanical impedance with a primary minimum value in the frequency range of 1800–3100 Hz and more preferably 1800–2600 Hz after the ball has been maintained at 21.1° C., 1 atm. and about 50% relative humidity for at least 15 hours.

A further preferred form of the invention is a golf ball comprising a core, and an outer cover layer having a Shore D hardness of at least 58, the ball having a mechanical impedance with a primary minimum value in the frequency range of 2600 Hz or less and more preferably 100–2600 Hz after the ball has been maintained at 21.1° C., 1 atm. and about 50% relative humidity for at least 15 hours. In a particularly preferred form of the invention, the core has a PGA compression of 55 or less. The ball preferably has a PGA compression of 80 or less.

Yet another preferred form of the invention is a golf ball comprising a core having a PGA compression of 55 or less, and an outer cover layer with a Shore D hardness of at least 58, the ball having a mechanical impedance with a primary minimum value in the frequency range of 2600 Hz or less and more preferably 100–2600 Hz after the ball has been maintained at 21.1° C., 1 atm. and about 50% relative humidity for at least 15 hours. The ball preferably has a PGA compression of 80 or less. The outer cover layer preferably has a Shore D hardness of at least 60. In a particularly preferred form of the invention, the ball has a coefficient of restitution of at least 0.790.

The invention accordingly comprises the article possessing the features, properties, and the relation of elements exemplified in the following detailed disclosure.

DETAILED DESCRIPTION OF THE INVENTION

Figure 1:
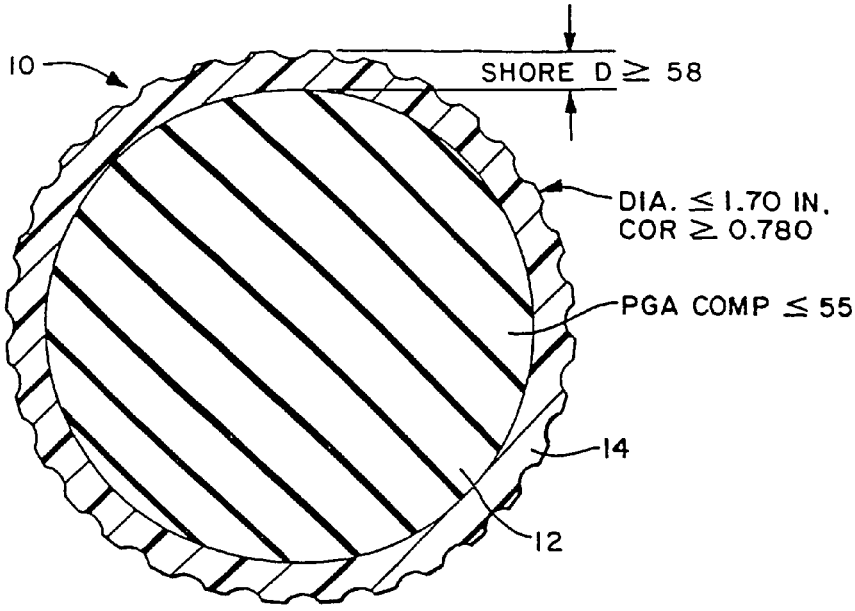
FIG. 1 is a cross-sectional view of a golf ball according to the present invention having a unitary, solid core and a single cover layer.

The present invention relates to a golf ball having a soft core and a cover surrounding the core. The ball has a soft sound and a cover which is hard or which has intermediate hardness. The soft sound is achieved by combining a soft core with a PGA compression of 55 or less with an appropriate cover. The ball in one preferred form of the invention has a mechanical impedance with a primary minimum value in the frequency range of 3200 Hz or less.

The core of the golf ball of the present invention can be solid, liquid filled or wound, but preferably is solid. The solid core preferably is made of polybutadiene, natural rubber, metallocene catalyzed polyolefin such as EXACT (commercially available from Exxon Chem. Co.) and ENGAGE (commercially available from Dow Chem. Co.), polyurethanes, silicones, polyester, polyamides, other thermoplastic or thermoset elastomers, and mixtures of one or more of the above materials. The core may be formed from a uniform composition or may optionally have two or more layers. Also, the core may be foamed to create a cellular structure or may be unfoamed.

The diameter of the core is determined based upon the desired overall ball diameter, minus the combined thicknesses of the cover layers. The COR of the core is appropriate to impart to the finished golf ball a COR of at least 0.700, and preferably at least 0.750. The core typically, but not necessarily, has a diameter of about 0.80–1.62 inches, preferably 1.2–1.6 inches, and a PGA compression of 10–55, more preferably 20–55. The golf ball preferably has a COR in the range of 0.700–0.850.

Conventional solid cores are typically compression molded from a slug of uncured or lightly cured elastomer composition comprising a high cis content polybutadiene and a metal salt of an alpha, beta, ethylenically unsaturated carboxylic acid such as zinc mono or diacrylate or methacrylate. To achieve higher coefficients of restitution in the core, the manufacturer may include fullers such as small amounts of a metal oxide such as zinc oxide. In addition, larger amounts of metal oxide than those that are needed to achieve the desired coefficient are often included in conventional cores in order to increase the core weight so that the finished ball more closely approaches the U.S.G.A. upper weight limit of 1.620 ounces. Other materials may be used in the core composition including compatible rubbers or ionomers, and low molecular weight fatty acids such as stearic acid. Free radical initiators such as peroxides are admixed with the core composition so that on the application of heat and pressure, a complex curing cross-linking reaction takes place.

The cover layers can be formed over the cores by injection molding, compression molding, casting or other conventional molding techniques. Each layer preferably is separately formed. It is preferable to form each layer by either injection molding or compression molding. A more preferred method of making a golf ball of the invention with a multi-layer cover is to successively injection mold each layer in a separate mold. First, the inner cover layer is injection molded over the core in a smooth cavity mold, subsequently any intermediate cover layers are injection molded over the inner cover layer in a smooth cavity mold, and finally the outer cover layer is injection molded over the intermediate cover layers in a dimpled cavity mold.

The outer cover layer of the golf ball of the present invention is based on a resin material. Non-limiting examples of suitable materials are ionomers, plastomers such as metallocene catalyzed polyolefins, e.g., EXACT, ENGAGE, INSITE or AFFINITY which preferably are cross-linked, polyamides, amide-ester elastomers, graft copolymers of ionomer and polyamide such as CAPRON, ZYTEL, PEBAX, etc., blends containing cross-linked transpolyisoprene, thermoplastic block polyesters such as HYTREL, or thermoplastic or thermosetting polyurethanes and polyureas such as ESTANE, which is thermoplastic polyurethane.

Any inner cover layers which are part of the ball can be made of any of the materials listed in the previous paragraph as being useful for forming an outer cover layer. Furthermore, any inner cover layers can be formed from a number of other non-ionomeric thermoplastics and thermosets. For example, lower cost polyolefins and thermoplastic elastomers can be used. Non-limiting examples of suitable non-ionomeric polyolefin materials include low density polyethylene, linear low density polyethylene, high density polyethylene, polypropylene, rubber-toughened olefin polymers, acid copolymers which do not become part of an ionomeric copolymer when used in the inner cover layer, such as PRIMACOR, NUCREL, ESCOR and ATX, flexomers, thermoplastic elastomers such as styene/butadiene/styrene (SBS) or styrene/ethylene-butylene/styrene (SEBS) block copolymers, including Kraton (Shell), dynamically vulcanized elastomers such as Santoprene (Monsanto), ethylene vinyl acetates such as Elvax (DuPont), ethylene methyl acrylates such as Optema (Exxon), polyvinyl chloride resins, and other elastomeric materials may be used. Mixtures, blends, or alloys involving the materials described above can be used. It is desirable that the material used for the inner cover layer be a tough, low density material. The non-ionomeric materials can be mixed with ionomers.

The outer cover layer and any inner cover layers optionally may include processing aids, release agents and/or diluents. Another useful material for any inner cover layer or layers is a natural rubber latex (prevulcanized) which has a tensile strength of 4,000–5,000 psi, high resilience, good scuff resistance, a Shore D hardness of less than 15 and an elongation of >500%.

When the ball has a single cover layer, it has a thickness of 0.010–0.500 inches, preferably 0.015–0.200 inches, and more preferably 0.025–0.150 inches. When the ball has two or more cover layers, the outer cover layer typically has a thickness of 0.01–0.20 inches, preferably 0.02–0.20 inches, and more preferably 0.025–0.15 inches. The one or more inner cover layers have thicknesses appropriate to result in an overall cover thickness of 0.03–0.50 inches, preferably 0.05–0.30 inches and more preferably 0.10–0.20 inches, with the minimum thickness of any single inner cover layer preferably being 0.01 inches. The ball typically, but not necessarily, has a diameter of 1.6 to 1.74 inches, and preferably 1.68–1.70 inches.

The core and/or cover layers of the golf ball optionally can include fillers to adjust, for example, flex modulus, density, mold release, and/or melt flow index. A description of suitable fillers is provided below in the "Definitions" section.

The physical characteristics of the cover are such that the ball has a soft feel. When a single cover layer is used, the Shore D hardness of that cover layer is at least 60 in one preferred form of the invention. When the ball has a multi-layer cover, the Shore D hardness of the outer cover layer is at least 60 in another preferred form of the invention. Preferably, the outer cover layer in a single or multi-layer covered ball has a Shore D hardness of at least 63, more preferably at least 65, and most preferably at least 67. The preferred maximum Shore D hardness for the outer cover layer is 90.

A particularly preferred embodiment of an outer cover layer for use in forming the golf ball of the present invention incorporates ionomer resins. An even more preferred embodiment incorporates high molecular weight ionomer resins, such as EX 1005, 1006, 1007, 1008 and 1009, provided by Exxon Chem. Co., or any combination thereof. These resins are particularly useful in forming the outer cover layer because they have a tensile modulus/hardness ratio that allows for a hard cover over a soft core while maintaining durability. The physical properties of these ionomer resins are shown below.

TABLE 1

Examples of Exxon High Molecular Weight Ionomers

| PROPERTY | Ex 1005 | Ex 1006 | Ex 1007 | Ex 1008 | Ex 1009 | 7310 |
|---|---|---|---|---|---|---|
| Melt Index. g/10 min. | 0.7 | 1.3 | 1.0 | 1.4 | 0.8 | 1.0 |
| Cation | Na | Na | Zn | Zn | Na | Zn |
| Melting Point. ° C. | 85.3 | 86 | 85.8 | 86 | 91.3 | 91 |
| Vicat Softening Point. ° C. | 54 | 57 | 60.5 | 60 | 56 | 69 |
| Tensile @ Break, MPa | 33.9 | 33.5 | 24.1 | 23.6 | 32.4 | 24 |
| Elongation @ Break, % | 403 | 421 | 472 | 427 | 473 | 520 |
| Hardness, Shore D | 58 | 58 | 51 | 50 | 56 | 52 |
| Flexural Modulus, MPa | 289 | 290 | 152 | 141 | 282 | 150 |

Appropriate fillers or additive materials may also be added to produce the cover compositions of the present invention. These additive materials include dyes (for example, Ultramarine Blue sold by Whitaker, Clark and Daniels of South Plainfield, N.J.), and pigments, i.e., white pigments such as titanium dioxide (for example UNITANE 0-110 commercially available from Kemira, Savannah, Ga.) zinc oxide, and zinc sulfate, as well as fluorescent pigments. As indicated in U.S. Pat. No. 4,884,814, the amount of pigment and/or dye used in conjunction with the polymeric cover composition depends on the particular base ionomer mixture utilized and the particular pigment and/or dye utilized. The concentration of the pigment in the polymeric cover composition can be from about 1% to about 10% as based on the weight of the base ionomer mixture. A more preferred range is from about 1% to about 5% as based on the weight of the base ionomer mixture. The most preferred range is from about 1% to about 3% as based on weight of the base ionomer mixture. The most preferred pigment for use in accordance with this invention is titanium dioxide (Anatase).

Moreover, since there are various hues of white, i.e. blue white, yellow white, etc., trace amounts of blue pigment may be added to the cover stock composition to impart a blue white appearance thereto. However, if different hues of the color white are desired, different pigments can be added to the cover composition at the amounts necessary to produce the color desired.

In addition, it is within the purview of this invention to add to the cover compositions of this invention compatible materials which do not effect the basic novel characteristics of the composition of this invention. Among such materials are antioxidants (i.e. Santonox R), commercially available from Flexysys, Akron, Ohio antistatic agents, stabilizers, compatablizers and processing aids. The cover compositions of the present invention may also contain softening agents, such as plasticizers, etc., and reinforcing materials, as long as the desired properties produced by the golf ball covers of the invention are not impaired.

Furthermore, optical brighteners, such as those disclosed in U.S. Pat. No. 4,679,795 may also be included in the cover composition of the invention. Examples of suitable optical brighteners which can be used in accordance with this Invention are Uvitex OB as sold by the Ciba-Geigy Chemical Company, Ardsley, N.Y. Uvitex OB is believed to be 2,5-Bis(5-tert-butyl-2-benzoxazoyl)-thiophene. Examples of other optical brighteners suitable for use in accordance with this invention are as follows: Leucopure EGM as sold by Sandoz, East Hanover, N.J. 07936. Leucopure EGM is thought to be 7-(2n-naphthol(1,2-d)-triazol-2yl(3phenyl-coumarin. Phorwhite K-20G2 is sold by Mobay Chemical Corporation, P.O. Box 385, Union Metro Park, Union, N.J. 07083, and is thought to be a pyrazoline derivative. Eastobrite OB-1 as sold by Eastman Chemical Products, Inc., Kingsport, Tenn. is thought to be 4,4-Bis(-benzoxaczoyl) stilbene. The above-mentioned UVITEX and EASTO-BRITE OB-1 are preferred optical brightners for use In accordance with this invention.

Moreover, since many optical brighteners are colored, the percentage of optical brighteners utilized must not be excessive in order to prevent the optical brightener from functioning as a pigment or dye in its own right.

The percentage of optical brighteners which can be used in accordance with this invention is from about 0.01% to about 0.5% as based on the weight of the polymer used as a cover stock. A more preferred range is from about 0.05% to about 0.25% with the most preferred range from about 0.10% to about 0.20% depending on the optical properties of the particular optical brightener used and the polymeric environment in which it is a part.

Generally, the additives are admixed with a ionomer to be used in the cover composition to provide a masterbatch (abbreviated herein as MB) of desired concentration and an amount of the masterbatch sufficient to provide the desired amounts of additive is then admixed with the copolymer blends.

As indicated above, the golf ball of the present invention preferably has a mechanical impedance with a primary minimum value in the frequency range of 3200 Hz or less, and preferably 100–3200 Hz. This low mechanical impedance provides the ball with a soft feel This soft feel in combination with excellent distance provide a golf ball which is particularly well suited for use by intermediate players who like a soft ball but desire a greater distance than can be achieved with a conventional balata ball.

Mechanical impedance is defined as the ratio of magnitude and force acting at a particular point to a magnitude of a responsive velocity at another point when the force is acted. Stated another way, mechanical impedance Z is given by Z=F/V, where F is an externally applied force and V is a responsive where F is an externally applied force and V is a responsive velocity of the object to which the force is applied. The velocity V is the internal velocity of the object.

Mechanical impedance and natural frequency can be depicted graphically by plotting impedence on the Y axis and frequency N (Hz) on the "X" axis. Graphs of this type are shown below in FIGS. 10–17.

Figure 10:
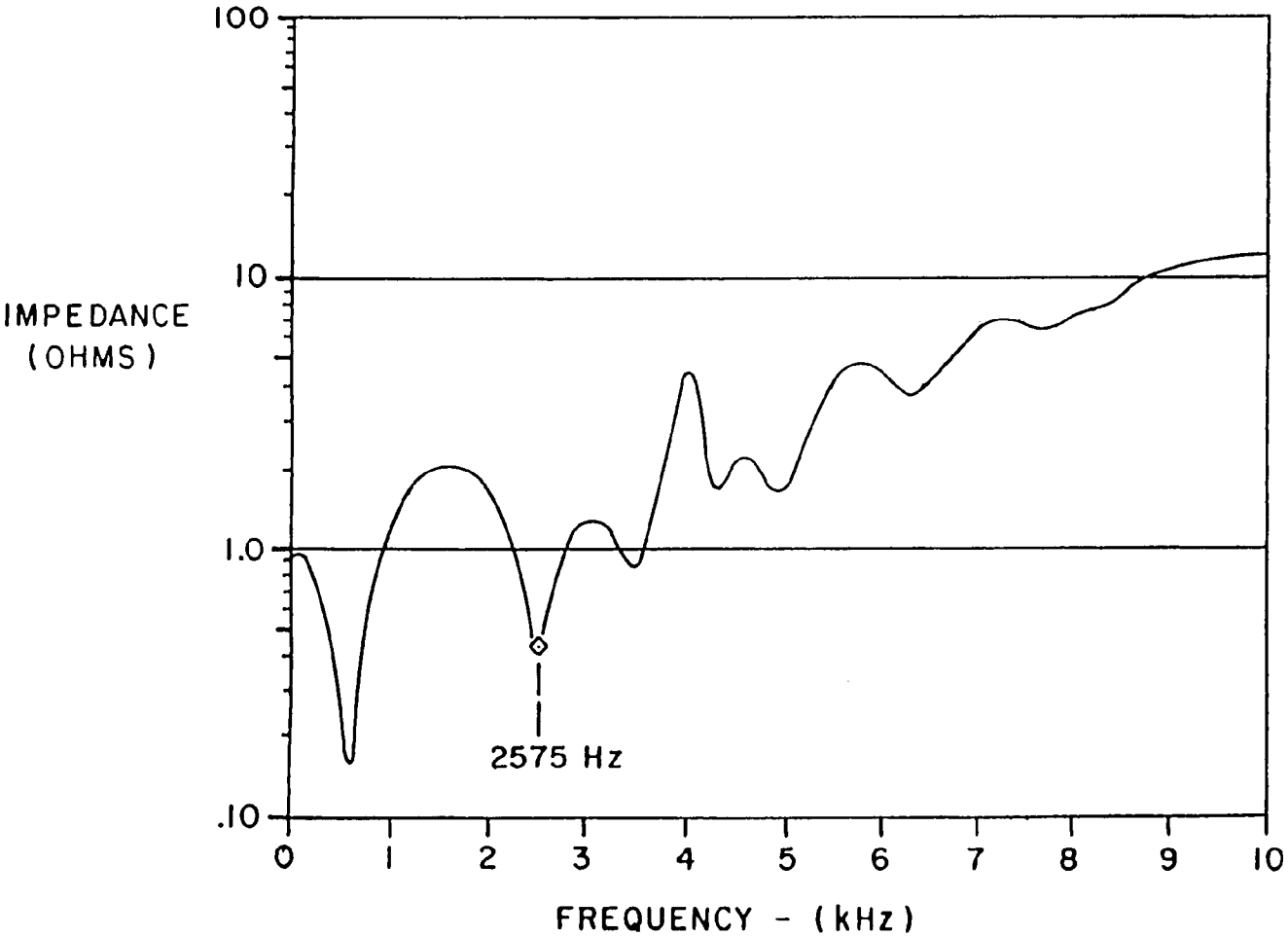
FIGS. 10–17 are graphs showing mechanical impedance for the golf balls tested in Example 4.
Figure 11:
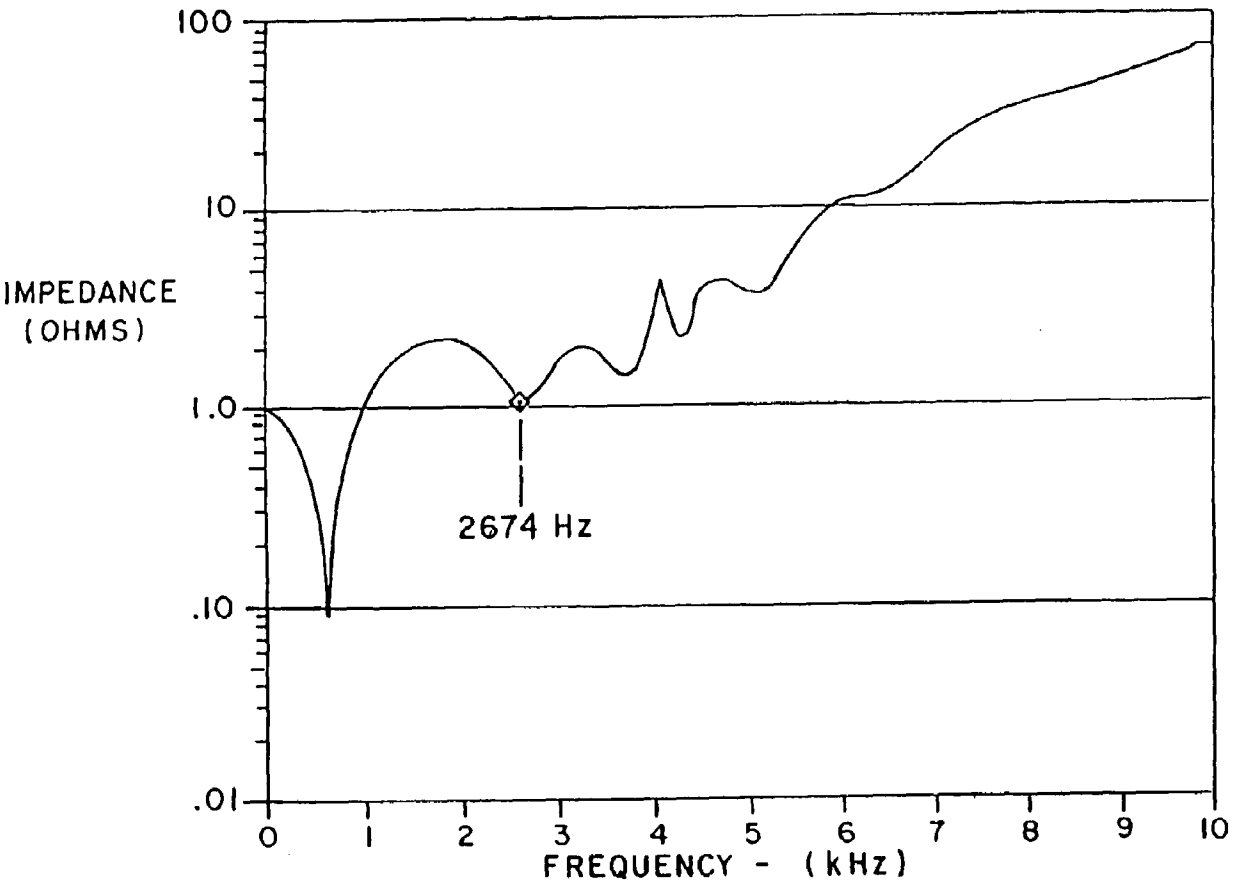
Figure 12:
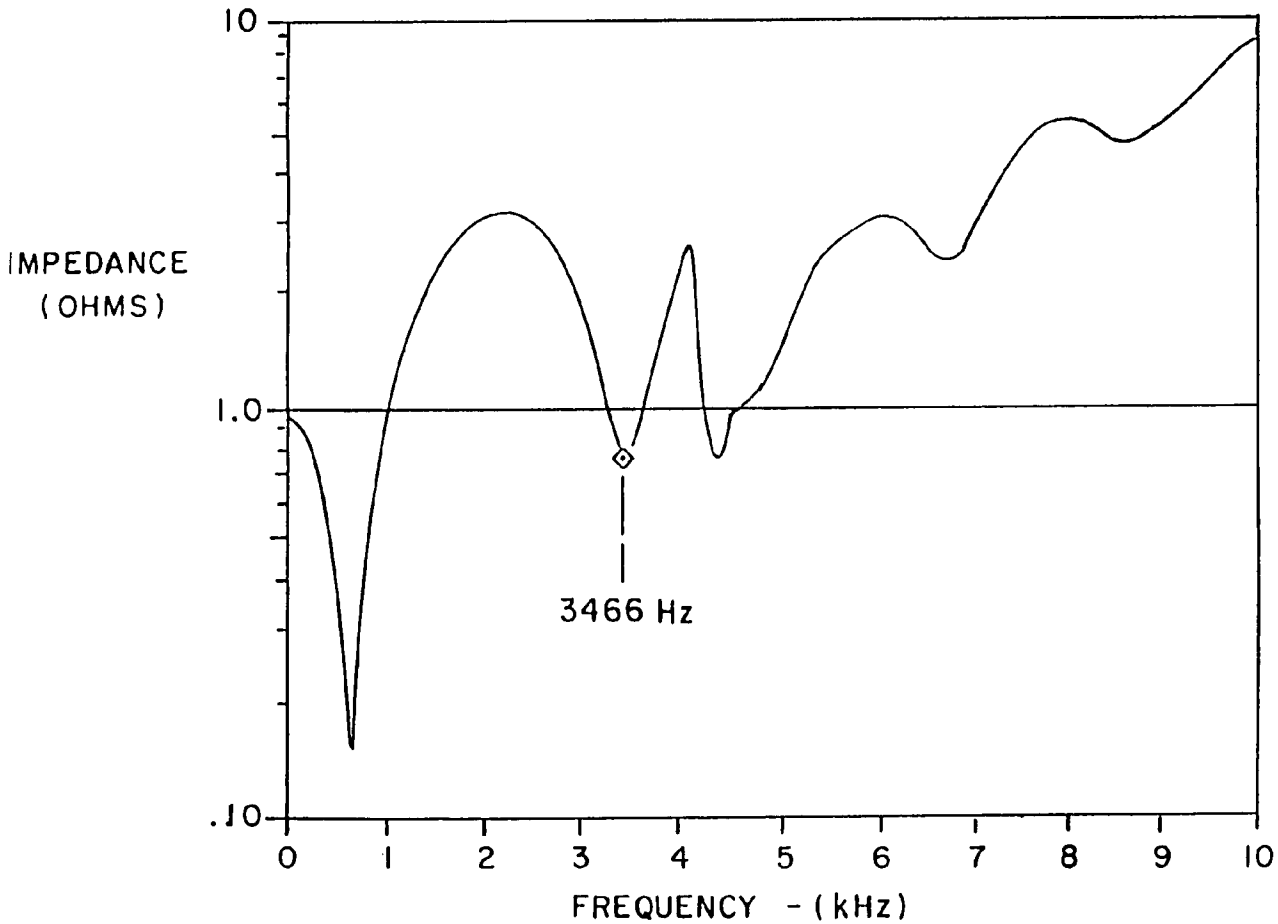
Figure 13:
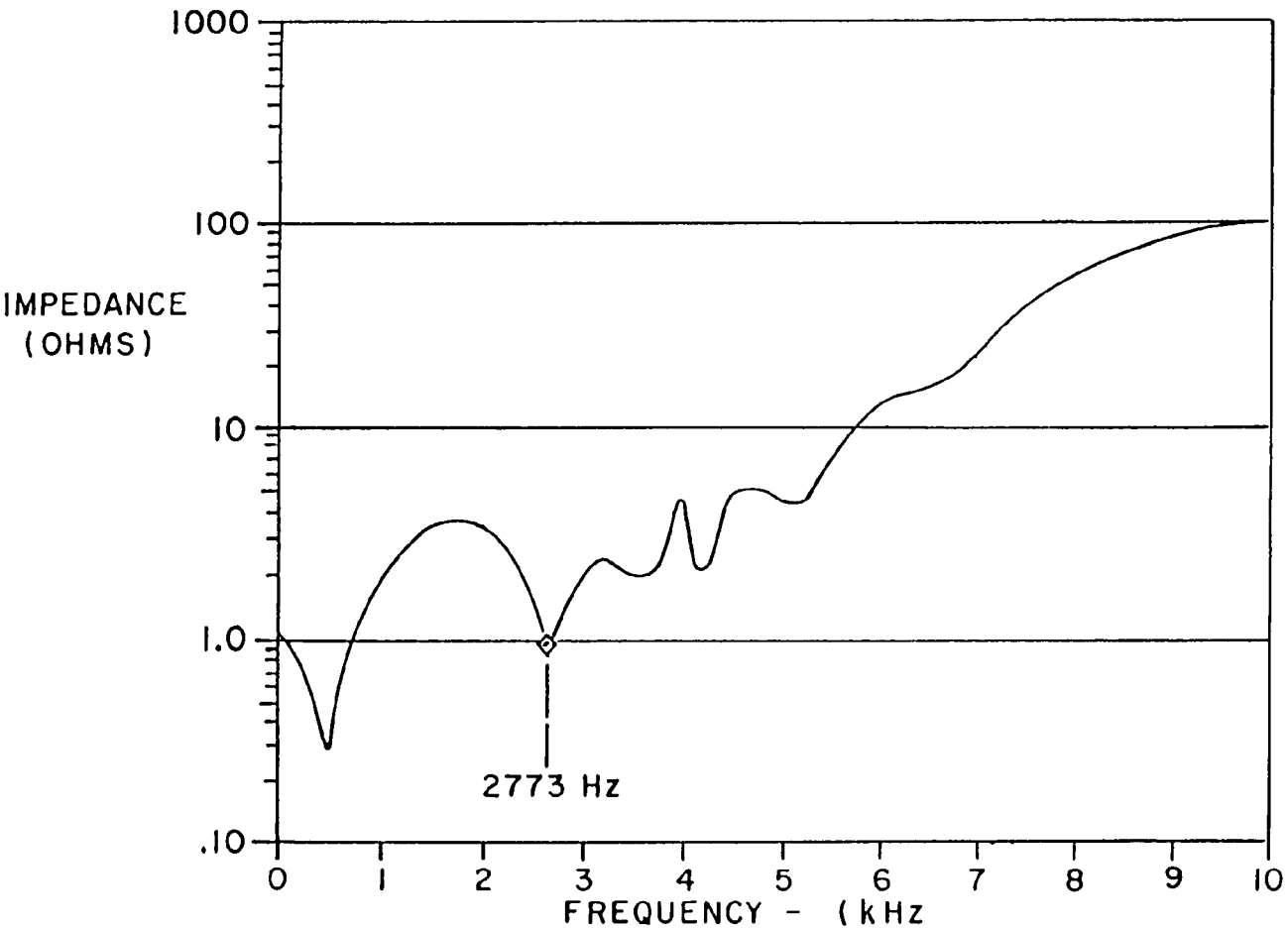
Figure 14:
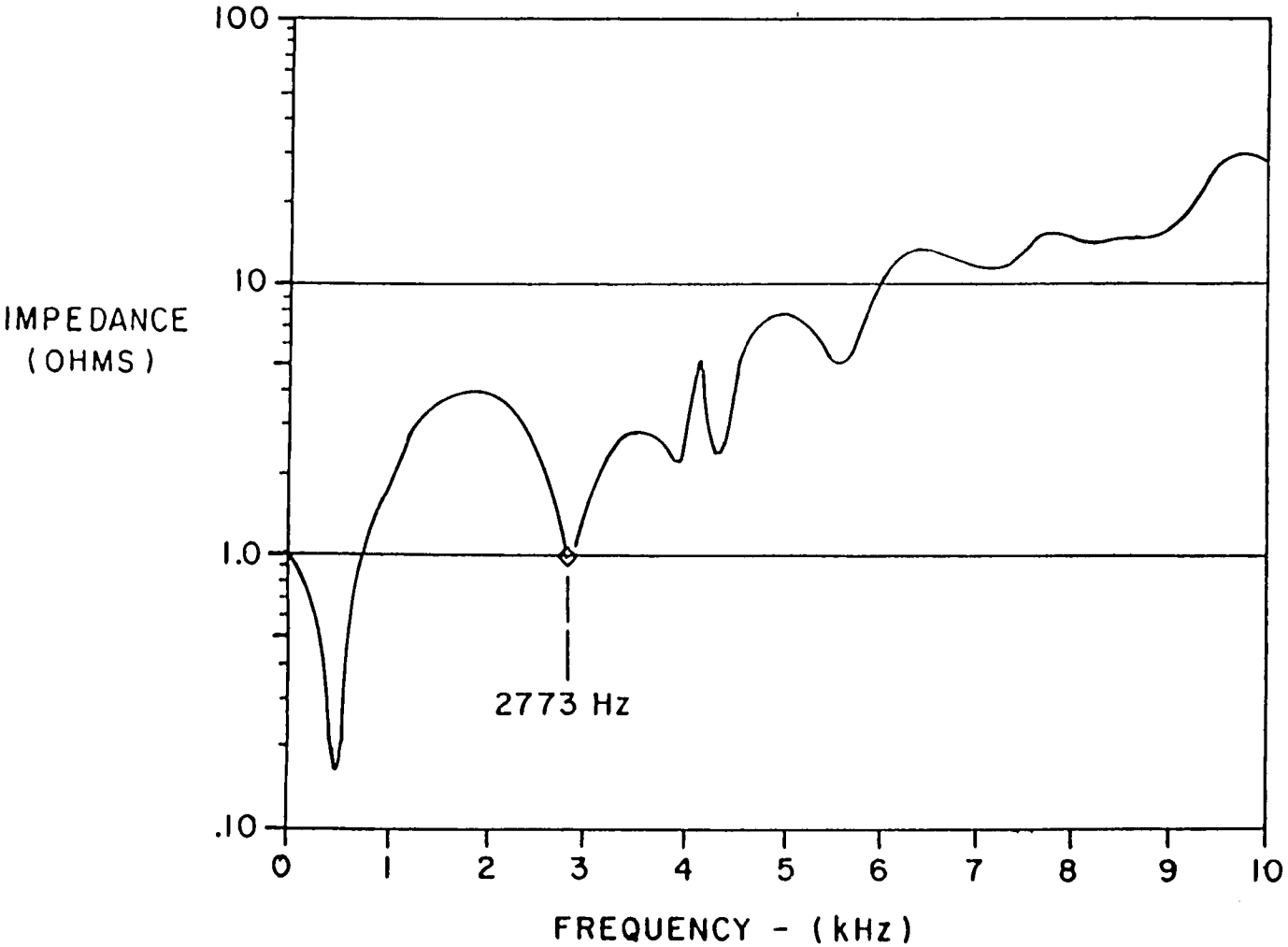
Figure 15:
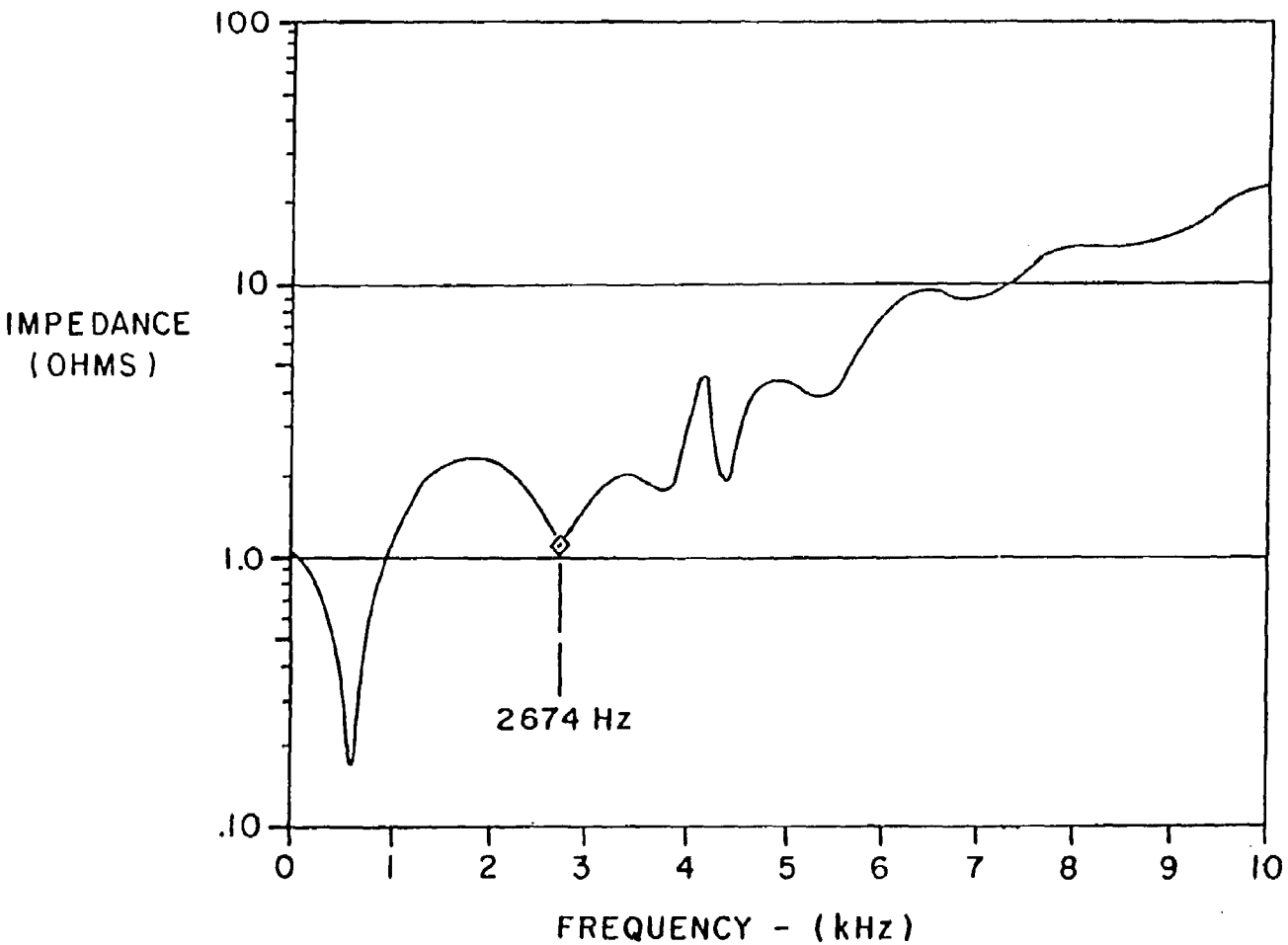
Figure 16:
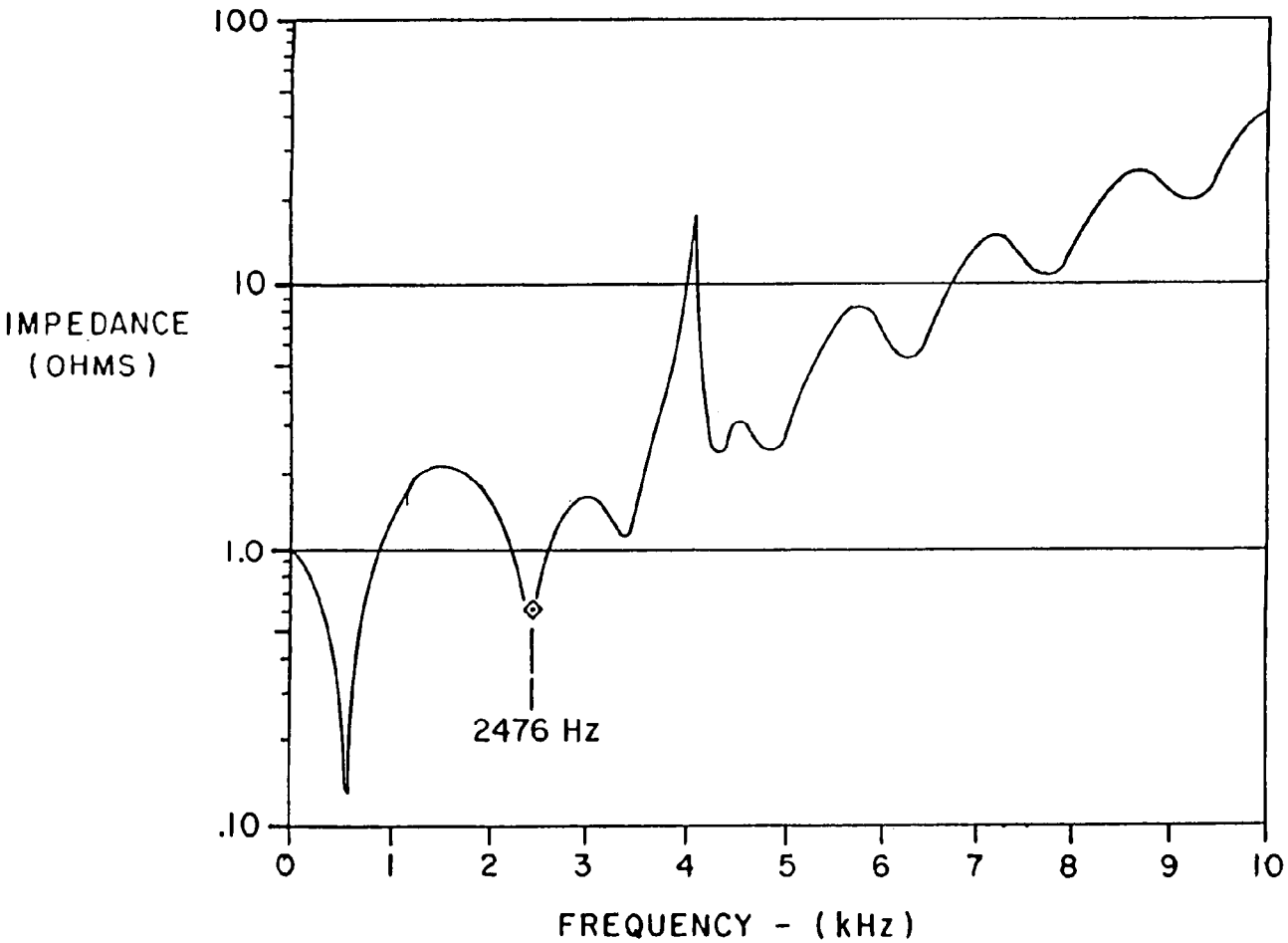
Figure 17:
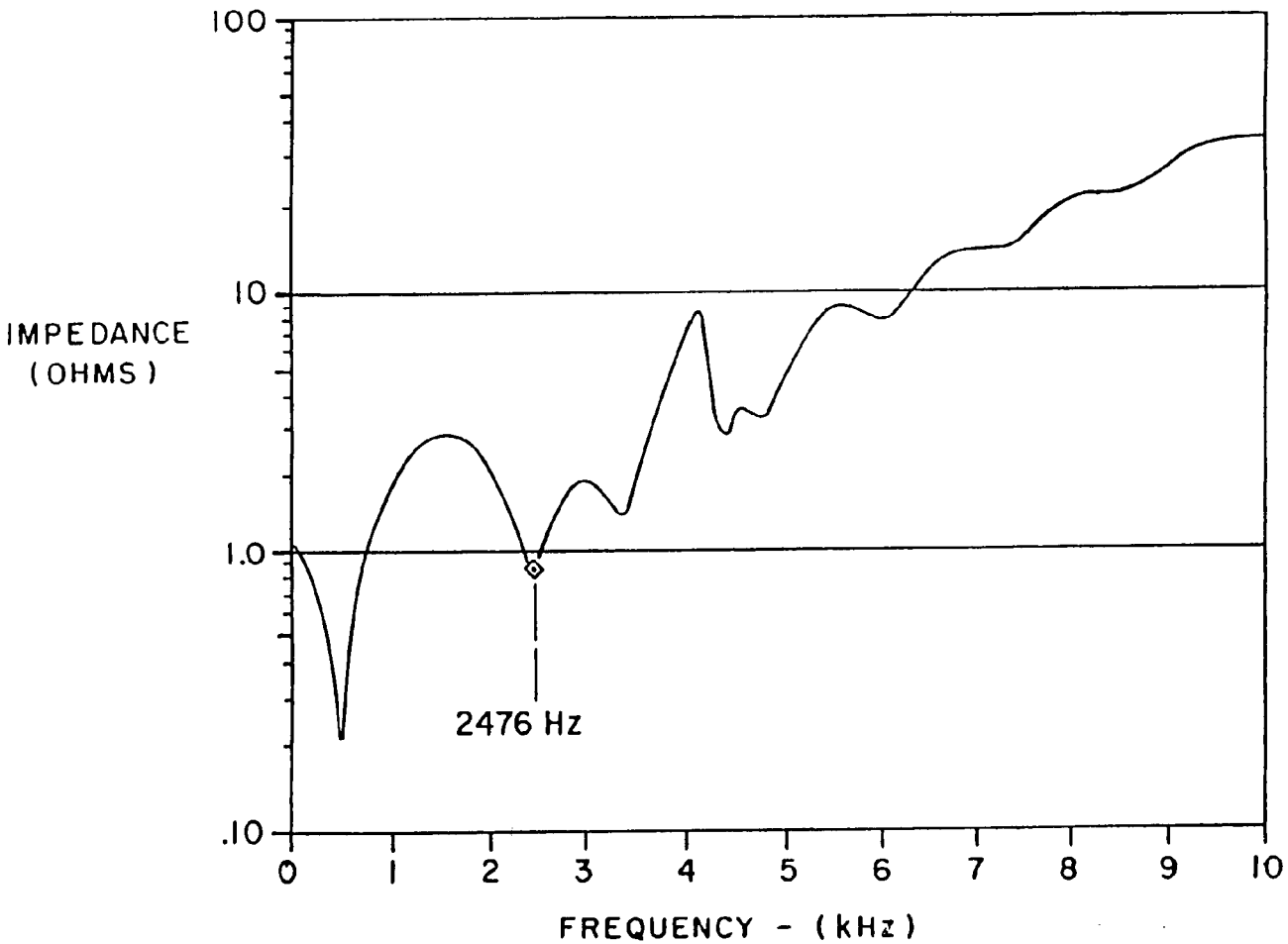

As shown in FIG. 10, a golf ball of Example 2 which is analyzed in Example 4 has a mechanical impedance with a primary minimum value at a first frequency, a mechanical impedance with a secondary minimum value at a higher frequency, and a third minimum value at an even higher frequency. These are known as the primary, secondary and tertiary minimum frequencies. The first minimum value which appears on the graph is not the primary minimum frequency of the ball but instead represents the forced node resonance of the ball due to the introduction of an artificial node, such as a golf club. The forced node resonance is a frequency which may depend in part upon the nature of the artificial node. The existence of forced node resonance is analogous to the change in frequency which is obtained on a guitar by placing a finger over a fret.

The mechanical impedance of an object can be measured using an accelerometer. Further details regarding natural frequency determinations are provided below in the Examples.

Referring to FIG. 1, a first embodiment of a golf ball according to present invention is shown and is designated as 10. The ball includes a central core 12 formed from polybutadiene or another cross-linked rubber. A cover layer 14 surrounds the core. The core has a PGA compression of 55 or less. The cover has a Shore D hardness of at least 60. The ball has a PGA compression of 80 or less.

Figure 2:
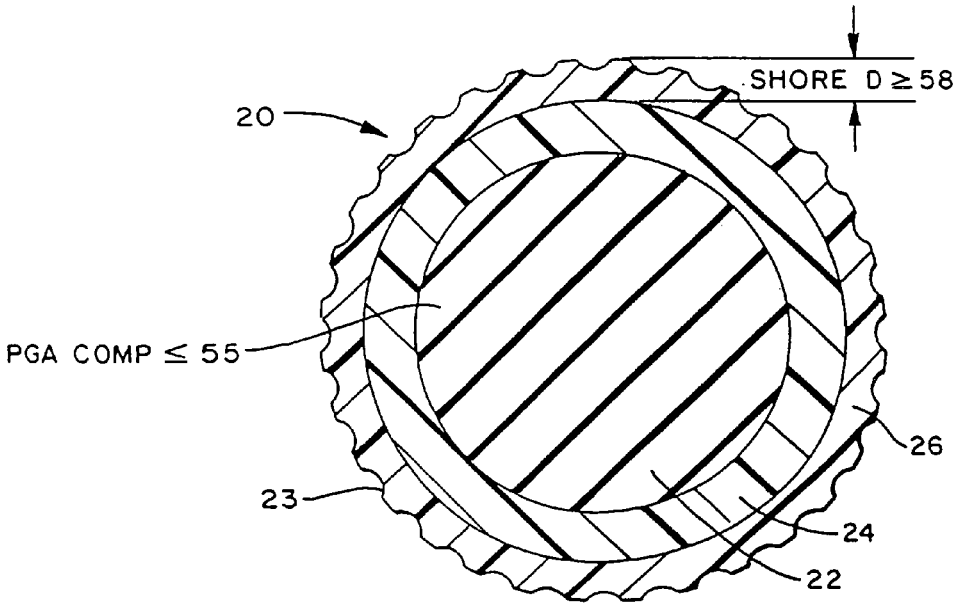
FIG. 2 is a cross-sectional view of a second embodiment of the invention in which the ball has two cover layers.

Referring now to FIG. 2, a cross-sectional view of a second embodiment of the invention is shown, and is designated as 20. The ball 20 has a solid core 22, an inner cover layer 24, and an outer cover layer 26. The core has a PGA compression of 55 or less. The outer cover layer has a Shore D hardness of 60 or more. The inner cover layer can be softer or harder than the outer cover layer, but provides the overall ball with a PGA compression of 80 or less.

Figure 3:
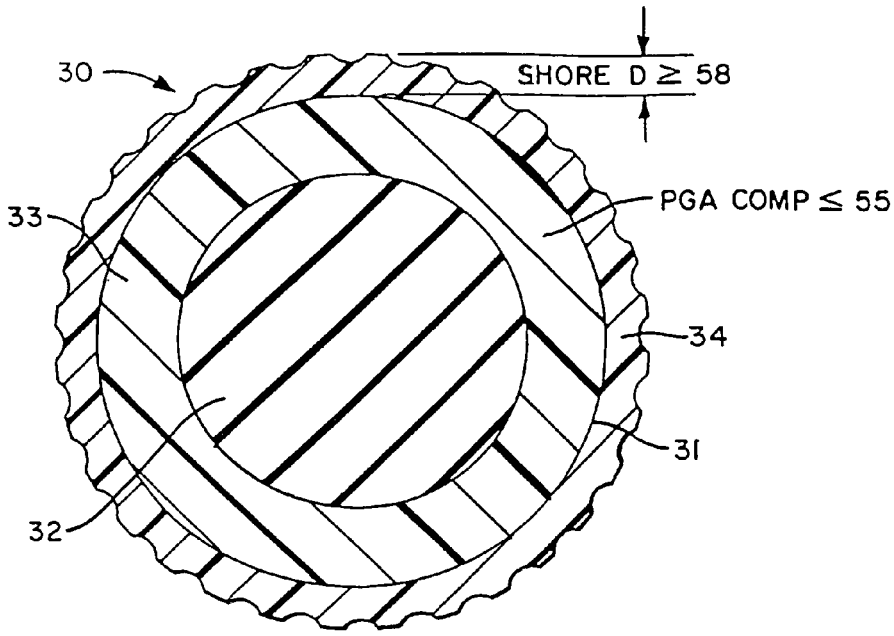
FIG. 3 is a cross-sectional view of a third embodiment of a golf ball according to the present invention in which the ball has a dual layer solid core.

A third embodiment of a golf ball according to the present invention is shown in FIG. 3, and is designated as 30. The ball includes a solid core 31 which is formed from two layers, namely, IS an inner core layer 32 and an outer core layer 33. A cover 34 surrounds the core 31. The inner core layer 32 and outer core layer 33 are selected to provide the overall core 31 with a PGA compression of 55 or less. The inner core layer may be harder or softer than the outer core layer and may also be higher in durability. The cover has a Shore D hardness of at least 60.The ball has a PGA compression of 80 or less.

Figure 4:
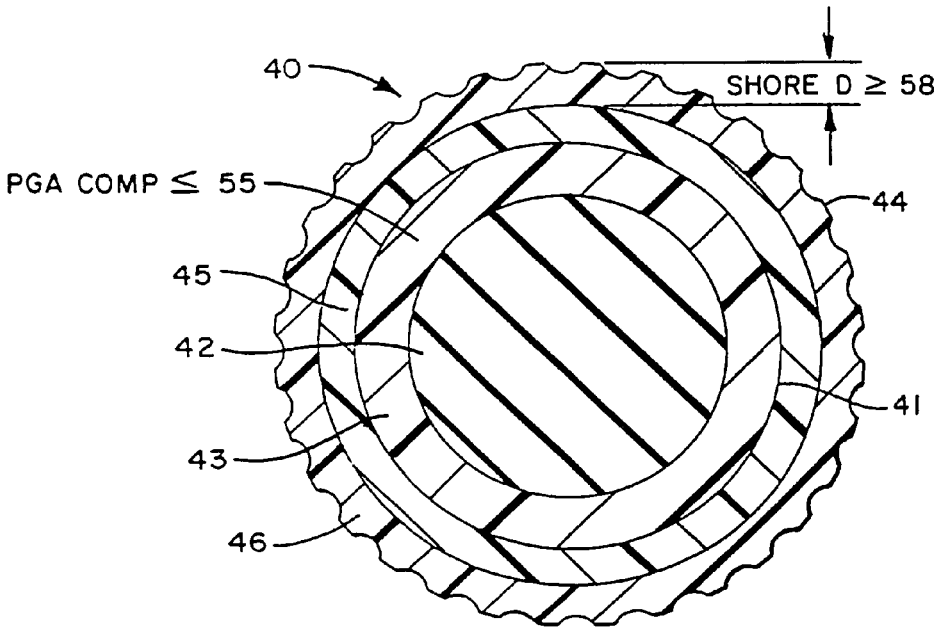
FIG. 4 is a cross-sectional view of a fourth embodiment of the present invention in which the ball has a dual layer solid core and a dual layer cover.

FIG. 4 shows a cross-sectional view of a fourth embodiment of a golf ball according to the present invention, which is designated as 40. The ball includes a core 41 having an inner core layer 42 and an outer core layer 43. A dual layer cover 44 surrounds the core 41. The dual layer cover 44 includes an inner cover layer 45 and an outer cover layer 46. The core 41 has a PGA compression of 55 or less. The outer cover layer 46 has a Shore D hardness of 60 or more. The ball has a PGA compression of 80 or less.

Figure 5:
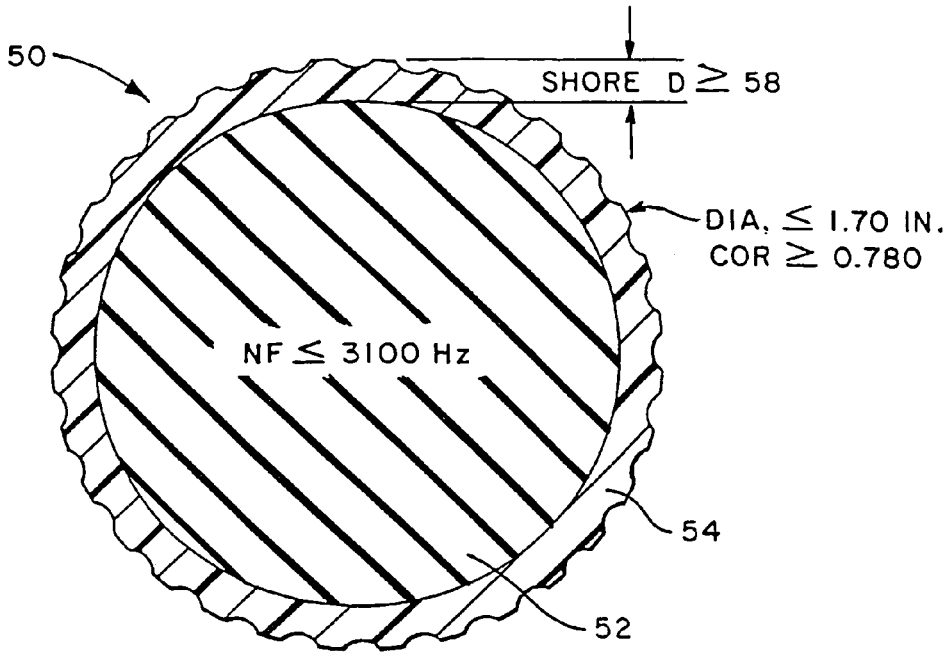
FIG. 5 is a cross-sectional view of an embodiment of the invention in which the ball has a mechanical impedance with a primary minimum value in a particular frequency range.

FIG. 5 shows yet another preferred embodiment of the present invention, which is designated as 50. The ball 50 has a core 52 formed from one or more layers and a cover 54 formed from one or more layers. The ball is constructed such that the outer cover layer has a Shore D hardness of at least 60, and the ball has a mechanical impedance with a primary minimum value in the frequency range of 3100 Hz or less after the ball has been maintained at 21.1° C., 1 atm. and about 50% relative humidity for at least 15 hours.

Figure 6:
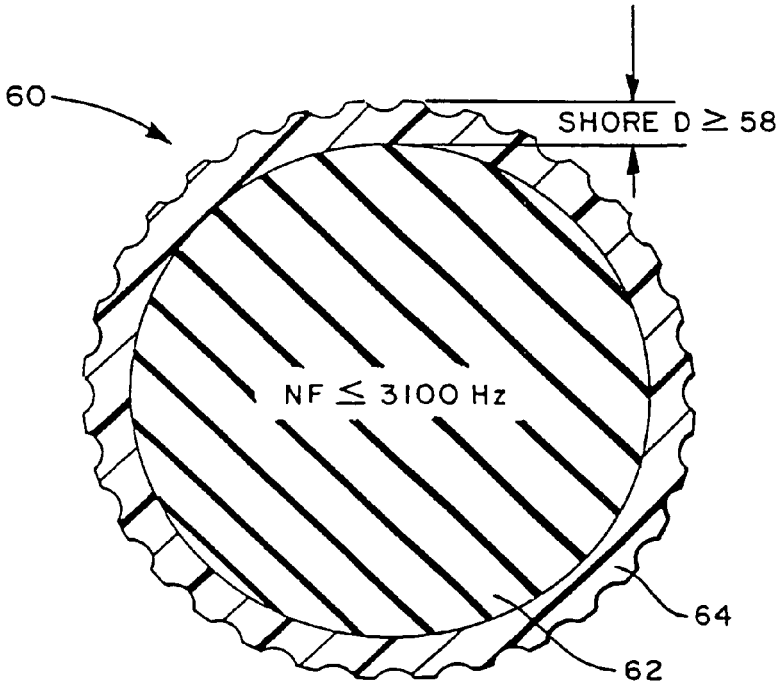
FIG. 6 is a cross-sectional view of a solid golf ball according to the invention in which the ball has a particular PGA core compression and a mechanical Impedance with a primary minimum value in a particular frequency range.

Yet another embodiment of a golf ball according to the invention is shown in FIG. 6 and is designated as 60. The ball has a solid core 62 and a cover 64, each of which can be formed of one or more layers. The core 62 has a PGA compression of 55 or less and the cover has a Shore D hardness of at least 58. The ball has a mechanical impedance with a primary minimum value in the frequency range of 3100 Hz or less after the ball has been maintained at 21.1° C., 1 atm. and about 50% relative humidity for at least 15 hours.

Figure 7:
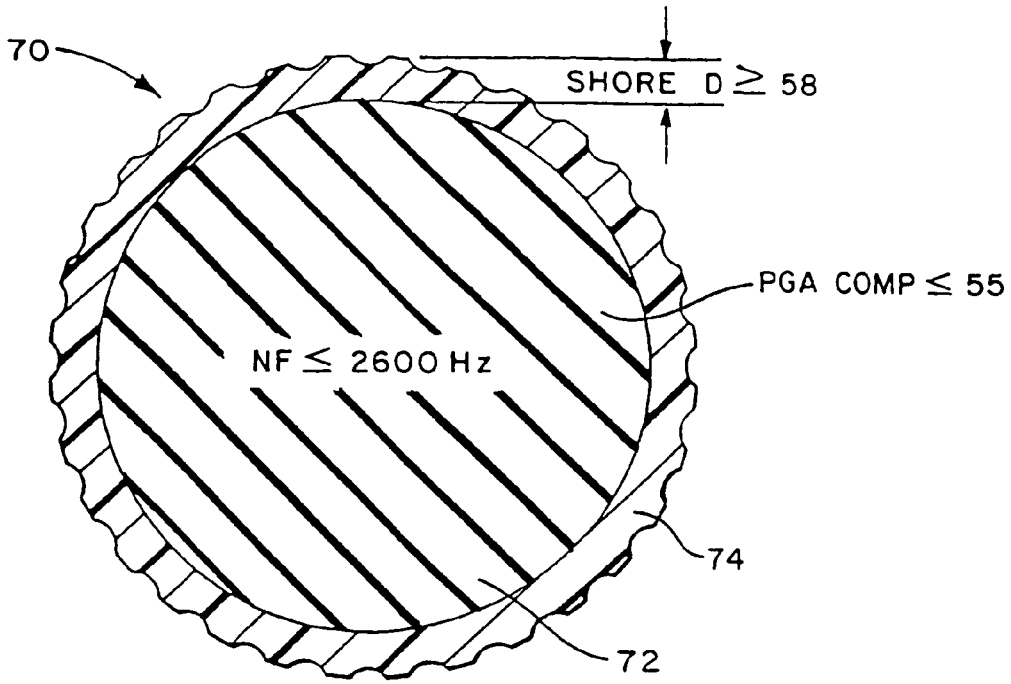
FIG. 7 shows a cross-sectional view of a golf ball according to yet another embodiment of the invention.

Yet another embodiment of a golf ball according to the invention is shown in FIG. 7. The ball 70 includes a solid or wound core 72 and a cover 74. Each of the core and cover can have one or more layers. The outer cover layer of the ball has a Shore D hardness of at least 60. The ball has a mechanical impedance with a primary minimum value in the frequency range of 2600 Hz or less after the ball has been maintained at 21.1° C., 1 atm. and about 50% relative humidity for at least 15 hours.

Figure 8:
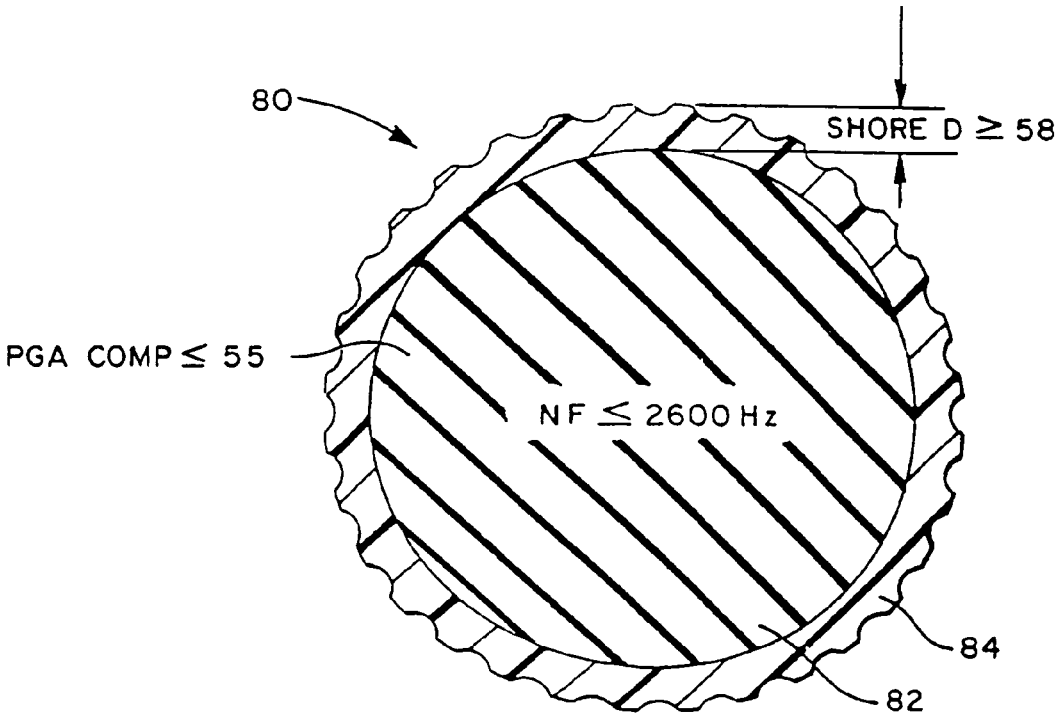
FIG. 8 shows a cross-sectional view of a golf ball according to a further embodiment of the invention.

Yet another preferred form of the invention is show In FIG. 8 and is designated as 80. The ball 80 has a core 82 which can be solid or wound, and a cover 84. The ball includes a core 82 which can be solid or wound, and can have one or more layers, and a cover 84 which can have one or more layers. The core has a PGA compression of 55 or less. The ball has a mechanical impedance with a primary minimum value in the frequency range of 2600 Hz or less after the ball has been maintained at 21.1° C., 1 atm. and about 50% relative humidity for at least 15 hours.

Definitions of Terms Used in Specification and Claims

PGA Compression

PGA compression is an important property involved in the performance of a golf ball. The compression of the ball can affect the playability of the ball on striking and the sound or "click" produced. Similarly, compression can effect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates. In effect the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, PGA compression indicates the amount of change in golf ball's shape upon striking. The development of solid core technology in two-piece balls has allowed for much more precise control of compression in comparison to thread wound three-piece balls. This is because in the manufacture of solid core balls, the amount of deflection or deformation is precisely controlled by the chemical formula used in making the cores. This differs from wound three-piece balls wherein compression is controlled in part by the winding process of the elastic thread. Thus, two-piece and multilayer solid core balls exhibit much more consistent compression readings than balls having wound cores such as the thread wound three-piece balls.

In the past, PGA compression related to a scale of from 0 to 200 given to a golf ball. The lower the PGA compression value, the softer the feel of the ball upon striking. In practice, tournament quality balls have compression ratings around 70–110, preferably around 80 to 100.

In determining PGA compression using the 0–200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200–100) and a ball which deflects 0.110 inches (110×0.001 inches) has a PGA compression of 90 (i.e., 200–110).

In order to assist in the determination of compression, several devices have been employed by the industry. For example, PGA compression is determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by Atti Engineering Corporation of Newark, N.J. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that it measures the upward movement of the spring-loaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicant also utilizes a modified Riehle Compression Machine originally produced by Riehle Bros. Testing Machine Company, Phil., Pa. to evaluate compression of the various components (i.e., cores, mantle cover balls, finished balls, etc.) of the golf balls. The Riehle compression device determines deformation in thousandths of an inch under a fixed initialized load of 200 pounds. Using such a device, a Riehle compression of 61 corresponds to a deflection under load of 0.061 inches.

Additionally, an approximate relationship between Riehle compression and PGA compression exists for balls of the same size. It has been determined by Applicant that Riehle compression corresponds to PGA compression by the general formula PGA compression=160−Riehle compression. Consequently, 80 Riehle compression corresponds to 80 PGA compression, 70 Riehle compression corresponds to 90 PGA compression, and 60 Riehle compression corresponds to 100 PGA compression. For reporting purposes, Applicant's compression values are usually measured as Riehle compression and converted to PGA compression.

Furthermore, additional compression devices may also be utilized to monitor golf ball compression so long as the correlation to PGA compression is know. These devices have been designed, such as a Whitney Tester, to correlate or correspond to PGA compression through a set relationship or formula.

Coefficient of Restitution (COR)

The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the coefficient of restitution (COR) and the surface configuration (dimple pattern, ratio of land area to dimple area, etc.) of the ball.

The COR in solid core balls is a function of the composition of the molded core and of the cover. The molded core and/or cover may be comprised of one or more layers such as in multi-layered balls. In balls containing a wound core (i.e., balk comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125±5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them. The screens were separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2° from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75 F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

Shore D Hardness

As used herein, "Shore D hardness" of a cover layer is measured generally in accordance with ASTM D-2240, except the measurements are made on the curved surface of a molded cover layer, rather than on a plaque. Furthermore, the Shore D hardness of the cover layer is measured while the cover layer remains over the core and any underlying cover layers. When a hardness measurement is made on a dimpled cover, Shore D hardness is measured at a land area of the dimpled cover.

Plastomers

Plastomers are polyolefin copolymers developed using metallocene single-site catalyst technology. Polyethylene plastomers generally have better impact resistance than polyethylenes made with Ziegler-Natta catalysts. Plastomers exhibit both thermoplastic and elastomeric characteristics. In addition to being comprised of a polyolefin such as ethylene, plastomers contain up to about 35 wt % comonomer. Plastomers include but are not limited to ethylene-butene copolymers, ethylene-octene copolymers, ethylene-hexene copolymers, and ethylene-hexene-butene terpolymers, as well as mixtures thereof.

The plastomers which are useful in the invention preferably are formed by a single site metallocene catalyst such as those disclosed in EP 29368, U.S. Pat. No. 4,752,597, U.S. Pat. No. 4,808,561, and U.S. Pat. No. 4,937,299, the teachings of which are incorporated herein by reference. Blends of plastomers can be used. Blends of plastomers with conventional core and/or cover materials also can be used. The plastomer can be crosslinked or uncrosslinked. As is known in the art, plastomers can be produced by solution, slurry and gas phase processes but the preferred materials are produced by metallocene catalysis using a high pressure process by polymerizing ethylene in combination with other olefin monomers, such as butene-1, hexene-1, octene-1 and 4-methyl-1-pentene in the presence of catalyst system comprising a cyclopentadienyl-transition metal compound and an alumoxane.

Plastomers found especially useful in the invention are those sold by Exxon Chemical under the trademark "EXACT" and include linear ethylene-butene copolymers such as EXACT 3024 having a density of about 0.905 g/cc (ASTM D-1505) and a melt index of about 4.5 g/10 min. (ASTM D-2839); EXACT 3025 having a density of about 0.910 g/cc (ASTM D-1505) and a melt index of about 1.2 g/10 min. (ASTM D-2839); EXACT 3027 having a density of about 0.900 g/cc (ASTM D-1505) and a melt index of about 3.5 g 10 min. (ASTM D-2839). Other useful plastomers include but are not limited to ethylene-hexene copolymers such as EXACT 3031 having a density of about 0.900 g/cc (ASTM D-1505) and a melt index of about 3.5 g/10 min. (ASTM D-2839), as well as EXACT 4049, which is an ethylene-butene copolymer having a density of about 0.873 g/cc (ASTM D-1505) and a melt index of about 4.5 g/10 min. (ASTM D-2839). All of the above EXACT series plastomers are available from EXXON Chemical Co.

EXACT plastomers typically have a dispersion index ($M_w/M_n$ where $M_w$ is weight average molecular weight and $M_n$ is number average molecular weight) of about 1.5 to 4.0, preferably 1.5–2.4, a molecular weight of about 5,000 to 50,000, preferably about 20,000 to about 30,000 a density of about 0.86 to about 0.93 g/cc, preferably about 0.87 g/cc to about 0.91 g/cc, a melting point of about 140–220 F, and a melt flow index (MI) above about 0.5 g/10 mins, preferably about 1–10 g/10 mins as determined by ASTM D-1238, condition E. Plastomers which may be employed in the invention include copolymers of ethylene and at least one $C_3$–$C_{20}$-olefin, preferably a $C_4$–$C_8$-olefin present in an amount of about 5 to about 32 wt %, preferably about 7 to about 22 wt %, more preferably about 9–18 wt %. These plastomers are believed to have a composition distribution breadth index of about 45% or more.

Plastomers such as those sold by Dow Chemical Co. under the trade name ENGAGE also may be employed in the invention. These plastomers are believed to be produced in accordance with U.S. Pat. No. 5,272,236, the teachings of which are incorporated herein by reference. These plastomers are substantially linear polymers having a density of about 0.85 g/cc to about 0.93 g/cc measured in accordance with ASTM D-792, a melt index (MI) of less than 30 g/10 minutes, a melt flow ratio ($I_{10}/I_2$) of about 7 to about 20, where $I_{10}$ is measured in accordance with ASTM D-1238 (190/10) and $I_2$ is measured in accordance with ASTM D-1238 (190/2.16), and a dispersion index $M_w/M_n$ which preferably is less than 5, and more preferably is less than about 3.5 and most preferably is from about 1.5 to about 2.5. These plastomers include homopolymers of $C_2$–$C_{20}$ olefins such as ethylene, propylene, 4-methyl-1-pentene, and the like, or they can be interpolymers of ethylene with at least one $C_3$–$C_{20}$-olefin and/or $C_2$–$C_{20}$ acetylenically unsaturated monomer and/or $C_4$–$C_{18}$ diolefins. These plastomers have a polymer backbone that is either unsubstituted or substituted with up to 3 long chain branches/1000 carbons. As used herein, long chain branching means a chain length of at least about 6 carbons, above which the length cannot be distinguished using $^{13}C$ nuclear magnetic resonance spectroscopy. The preferred ENGAGE plastomers are characterized by a saturated ethylene-octene backbone and a narrow dispersion index $M_w/M_n$ of about 2. Other commercially available plastomers may be useful in the invention, including those manufactured by Mitsui.

The dispersion index $M_w/M_n$ of plastomers made in accordance with U.S. Pat. No. 5,272,236 most preferably is about 2.0. Non-limiting examples of these plastomers include ENGAGE CL 8001 having a density of about 0.868 g/cc, a melt index of about 0.5 g/10 mins, and a Shore A hardness of about 75; ENGAGE CL 8002 having a density of about 0.87 g/cc, a melt index of about 1 gms/10 min, Shore A hardness of about 75; ENGAGE CL 8003 having a density of about 0.885 g/cc, melt index of about 1.0 gms/10 min, and a Shore A hardness of about 86; ENGAGE EG 8100 having a density of about 0.87 g/cc, a melt index of about 1 gms/10 min., and a Shore A hardness of about 87; ENGAGE 8150 having a density of about 0.868 g/cc, a melt index of about 0.5 gms/10 min, and a Shore A hardness of about 75; ENGAGE 8200 having a density of about 0.87 g/cc, a melt index of about 5 g/10 min., and a Shore A hardness of about 75; and ENGAGE EP 8500 having a density of about 0.87 gms/cc, a melt index of about 5 g/10 min., and a Shore A hardness of about 75.

Fillers

Fillers preferably are used to adjust the density, flex modulus, mold release, and/or melt flow index of the inner cover layer. More preferably, at least when the filler is for adjustment of density or flex modulus, it is present in an amount of at least five parts by weight based upon 100 parts by weight of the resin composition. With some fillers, up to about 200 parts by weight probably can be used. A density adjusting filler according to the invention preferably is a filler which has a specific gravity which is at least 0.05 and more preferably at least 0.1 higher or lower than the specific gravity of the resin composition. Particularly preferred density adjusting fillers have specific gravities which are higher than the specific gravity of the resin composition by 0.2 or more, even more preferably by 2.0 or more. A flex modulus adjusting filler according to the invention is a filler which, when used in an amount of e.g. 1–100 parts by weight based upon 100 parts by weight of resin composition, will raise or lower the flex modulus (ASTM D-790) of the resin composition by at least 1% and preferably at least 5% as compared to the flex modulus of the resin composition without the inclusion of the flex modulus adjusting filler. A mold release adjusting filler is a filler which allows for easier removal of part from mold, and eliminates or reduces the need for external release agents which otherwise could be applied to the mold. A mold release adjusting filler typically is used in an amount of up to about 2 wt % based upon the total weight of the inner cover layer. A melt flow index adjusting filler is a filler which increases or decreases the melt flow, or ease of processing of the composition.

The cover layers may contain coupling agents that increase adhesion of materials within a particular layer e.g. to couple a filler to a resin composition, or between adjacent layers. Non-limiting examples of coupling agents include titanates, zirconates and silanes. Coupling agents typically are used in amounts of 0.1–2 wt % based upon the total weight of the composition in which the coupling agent is included.

A density adjusting filler is used to control the moment of inertia, and thus the initial spin rate of the ball and spin decay. The additional a filler with a lower specific gravity than the resin composition results in a decrease in moment of inertia and a higher initial spin rate than would result if no filler were used. The addition of a filler with a higher specific gravity than the resin composition results in an increase in moment of inertia and a lower initial spin rate. High specific gravity fillers are preferred as less volume is used to achieve the desired inner cover total weight. Non-reinforcing fillers are also preferred as they have minimal effect on COR. Preferably, the filler does not chemically react with the resin composition to a substantial degree, although some reaction may occur when, for example, zinc oxide is used in a cover layer which contains some ionomer.

The density-increasing fillers for use in the invention preferably have a specific gravity in the range of 1.0–20. The density-reducing fillers for use in the invention preferably have a specific gravity of 0.06–1.4, and more preferably 0.06–0.90. The flex modulus increasing fillers have a reinforcing or stiffening effect due to their morphology, their interaction with the resin, or their inherent physical properties. The flex modulus reducing fillers have an opposite effect due to their relatively flexible properties compared to the matrix resin. The melt flow index increasing fillers have a flow enhancing effect due to their relatively high melt flow versus the matrix. The melt flow index decreasing fillers have an opposite effect due to their relatively low melt flow index versus the matrix.

Fillers may be or are typically in a finely divided form, for example, in a size generally less than about 20 mesh, preferably less than about 100 mesh U.S. standard size, except for fibers and flock, which are generally elongated. Flock and fiber sizes should be small enough to facilitate processing. Filler particle size will depend upon desired effect, cost, ease of addition, and dusting considerations. The filler preferably is selected from the group consisting of precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, tungsten carbide, metal oxides, metal stearates, particulate carbonaceous materials, micro balloons, and combinations thereof. Non-limiting examples of suitable fillers, their densities, and their preferred uses are as follows:

| Filler Type | Spec. Grav. | Comments |
|---|---|---|
| Precipitated hydrated silica | 2.0 | 1, 2 |
| Clay | 2.62 | 1, 2 |
| Talc | 2.85 | 1, 2 |
| Asbestos | 2.5 | 1, 2 |
| Glass fibers | 2.55 | 1, 2 |
| Aramid fibers (KEVLAR ®) | 1.44 | 1, 2 |
| Mica | 2.8 | 1, 2 |
| Calcium metasilicate | 2.9 | 1, 2 |
| Barium sulfate | 4.6 | 1, 2 |
| Zinc sulfide | 4.1 | 1, 2 |
| Lithopone | 4.2–4.3 | 1, 2 |
| Silicates | 2.1 | 1, 2 |
| Silicon carbide platelets | 3.18 | 1, 2 |
| Silicon carbide whiskers | 3.2 | 1, 2 |
| Tungsten carbide | 15.6 | 1 |
| Diatomaceous earth | 2.3 | 1, 2 |
| Polyvinyl chloride | 1.41 | 1, 2 |
| Carbonates | | |
| Calcium carbonate | 2.71 | 1, 2 |
| Magnesium carbonate | 2.20 | 1, 2 |
| Metals and Alloys (powders) | | |
| Titanium | 4.51 | 1 |
| Tungsten | 19.35 | 1 |
| Aluminum | 2.70 | 1 |
| Bismuth | 9.78 | 1 |
| Nickel | 8.90 | 1 |
| Molybdenum | 10.2 | 1 |
| Iron | 7.86 | 1 |
| Steel | 7.8–7.9 | 1 |
| Lead | 11.4 | 1, 2 |
| Copper | 8.94 | 1 |
| Brass | 8.2–8.4 | 1 |
| Boron | 2.34 | 1 |
| Boron carbide whiskers | 2.52 | 1, 2 |
| Bronze | 8.70–8.74 | 1 |
| Cobalt | 8.92 | 1 |
| Beryllium | 1.84 | 1 |
| Zinc | 7.14 | 1 |
| Tin | 7.31 | 1 |
| Metal Oxides | | |
| Zinc oxide | 5.57 | 1, 2 |
| Iron oxide | 5.1 | 1, 2 |
| Aluminum oxide | 4.0 | |
| Titanium oxide | 3.9–4.1 | 1, 2 |
| Magnesium oxide | 3.3–3.5 | 1, 2 |
| Zirconium oxide | 5.73 | 1, 2 |
| Metal Stearates | | |
| Zinc stearate | 1.09 | 3, 4 |
| Calcium stearate | 1.03 | 3, 4 |
| Barium stearate | 1.23 | 3, 4 |
| Lithium stearate | 1.01 | 3, 4 |
| Magnesium stearate | 1.03 | 3, 4 |

-continued

| Filler Type | Spec. Grav. | Comments |
|---|---|---|
| Particulate carbonaceous materials | | |
| Graphite | 1.5–1.8 | 1, 2 |
| Carbon black | 1.8 | 1, 2 |
| Natural bitumen | 1.2–1.4 | 1, 2 |
| Cotton flock | 1.3–1.4 | 1, 2 |
| Cellulose flock | 1.15–1.5 | 1, 2 |
| Leather fiber | 1.2–1.4 | 1, 2 |
| Micro ballons | | |
| Glass | 0.15–1.1 | 1, 2 |
| Ceramic | 0.2–0.7 | 1, 2 |
| Fly ash | 0.6–0.8 | 1, 2 |
| Coupling Agents Adhesion Promoters | | |
| Titanates | 0.95–1.17 | |
| Zironates | 0.92–1.11 | |
| Silane | 0.95–1.2 | |

1 Particularly useful for adjusting density of the inner cover layer.
2 Particularly useful for adjusting flex modulus of the inner cover layer.
3 Particularly useful for adjusting mold release of the inner cover layer.
4 Particularly useful for increasing melt flow index of the inner cover layer.

All fillers except for metal stearates would be expected to reduce

The amount of filler employed is primarily a function of weight requirements and distribution.

Ionomeric resins

Ionomeric resins include copolymers formed from the reaction of an olefin having 2 to 8 carbon atoms and an acid which includes at least one member selected from the group consisting of alpha, beta-ethylenically unsaturated mono- or dicarboxylic acids with a portion of the acid groups being neutralized with cations. Terpolymer ionomers further include an unsaturated monomer of the acrylate ester class having from 1 to 21 carbon atoms. The olefin preferably is an alpha olefin and more preferably is ethylene. The acid preferably is acrylic acid or methacrylic acid. The ionomers typically have a degree of neutralization of the acid groups in the range of about 10–100%. The following examples are included to assist in understanding the invention but are not intended to limit the scope of the invention unless otherwise specifically indicated.

EXAMPLES

Example 1

Manufacture of Golf Balls

A number of golf ball cores were made having the following formulation and characteristics were made.

| MATERIAL | WEIGHT |
|---|---|
| HIGH CIS POLYBUTADIENE CARIFLEX BR-1220[1] | 70 |
| HIGH CIS POLYBUTADIENE TAKTENE 220[2] | 30 |
| ZINC OXIDE[3] | 25 |
| CORE REGRIND[4] | 20 |
| ZINC STEARATE[5] | 15 |
| ZINC DIACRYLATE[6] | 18 |

-continued

| MATERIAL | WEIGHT |
|---|---|
| RED COLORANT | .14 |
| PEROXIDE (LUPERCO 23/XL OR TRIGANOX 29/40)[7] | .90 |

[1]Muehlstein, Norwalk, CT
[2]Bayer Corp., Akron, OH
[3]Zinc Corp of America, Monaca, PA
[4]golf ball core regrind (internal source)
[5]Synpro, Cleveland, OH
[6]Rockland React Rite, Rockland, GA
[7]R.T. Vanderbilt, Norwalk, CT The cores had a diameter of 1.560 inches, a PGA compression of about 40 and a COR of about 0.775. To make the cores, the core ingredients were intimately mixed in an internal mixer until the compositions were uniform, usually over a period of from about 5 to about 20 minutes. The sequence of addition of the components was not found to be critical As a result of shear during mixing, the temperature of the core mixtures rose to about 190° F. whereupon the batch was discharged onto a two roll mill, mixed for about one minute and sheeted out.

The sheet was rolled into a "pig" and then placed in a Barwell reformer and slugs produced. The slugs were then subjected to compression molding at about 310° F. for about 11½ minutes. After molding, the cores were cooled under ambient conditions for about 4 hours. The molded cores were then subjected to a centerless grinding operation whereby a thin layer of the molded core was removed to produce a round core having a diameter of 1.2 to 1.5 inches. Upon completion, the cores were measured for size and in some instances weighed and tested to determine compression and COR.

The cores were covered with an injection-molded cover blend of 35 parts by weight EX® 1006 (Exxon Chemical Corp., Houston, Tex.), 55.6 parts by weight EX 1007 (Exxon Chemical Corp., Houston, Tex.) and 9.4 parts by weight of Masterbatch. The Masterbatch contained 100 parts by weight Iotek 7030, 31.72 parts by weight titanium dioxide (Unitane 0-110), 0.6 parts by weight pigment (Ultramarine Blue), 0.35 parts by weight optical brightener (Eastobrite OB1) and 0.05 parts by weight stabilizer (Santanox R).

The cover had a thickness of 0.055 inches and a Shore D hardness of 67. The balls had a PGA compression of 65 and a COR of 0.795.

Example 2

Manufacture of Golf Balls

The procedure of Example 1 was repeated with the exception that a different cover formulation was used.

The cores were covered with a cover blend of 54.5 parts by weight Surlyn 9910, 22.0 parts by weight Surlyn 8940, 10.0 parts by weight Surlyn 8320, 4.0 parts by weight Surlyn 8120, and 9.5 parts by weight of Masterbatch. The Masterbatch had the same formulation as that of Example 1.

The cover had a thickness of 0.55 inches and a Shore D hardness of 63. The balls had a PGA compression of 63 and a COR of 0.792.

Example 3

Frequency Measurements of Golf Club/Ball Contact Based Upon Sound

A number of frequency measurements based upon audible sound were made for the sound of contact between a putter and a number of different types of golf balls, including the balls of Example 1. Three balls of each type were tested.

The putter was a 1997 Titleist Scotty Cameron putter. An accelerometer (Vibra-Metrics, Inc., Hamden, Conn., Model 9001A, Serial No. 1225) was placed on the back cavity of the putter head. The output of the accelerometer was powered by a Vibra-Metrics, Inc., Hamden, Conn., Model P5000 accelerometer power supply, at a gain of x1. A microphone was positioned proximate to the intended point of contact between the putter and the ball. The microphone stand was placed at the distal end of the putter head such that the microphone itself was positioned 3 centimeters above the sweet spot at a downfacing angle of 30°. A preamplifier (Realistic Model 42-2101A, Radio Shack was used for the microphone. Signals were collected using a Metrabyte Das-58 A-D board with a SSH-04 simultaneous sample and hold module (Keithley Instruments, Cleveland, Ohio) at a rate of 128 kHz. The microphone was a Radio Shack Model 33-3007 unidirectional condenser microphone with a frequency response of 50–15000 Hz.

The putter was positioned by a putting pendulum so that when properly balanced the ground clearance was one millimeter. The balls were hit from the sweet spot of the putter. The club was drawn back to the 20° mark on the putting pendulum. Contact with the ball occurred when the putter was at a 90° angle relative to the ground.

The point of contact between the club and the ball could be determined by viewing the signal from the accelerometer. Pre-trigger and post-trigger data was collected for each shot. Data was collected at 128 kHz for a duration of 64 microseconds, resulting in 8,192 data points per shot. The data was saved in ASCII text files for subsequent analysis. Each ball was struck 10 times in a random sequence, i.e., all 33 balls were struck before any ball was struck a second time and the striking order was randomly changed for each set of hits. Data for the three balls of each particular type was averaged. The results are shown below on Table 2.

TABLE 2

| MANU. | BALL | SOUND FREQ. (Hz) | STD. DEV. | COR (×1000) | PGA COMP |
|---|---|---|---|---|---|
| | Example 1 | 3.12 | 0.06 | 800 | 67 |
| Top Flite | Strata Tour 90 | 3.20 | 0.18 | 772 | 92 |
| | Strata Tour 100 | 3.46 | 0.03 | | |
| Titleist | Tour Balata (W) | 3.31 | 0.18 | 780 | 78 |
| | HP2 Tour | 3.73 | 0.29 | 772 | 92 |
| | DT Wound 100 | 3.66 | 0.29 | | |
| | DT 2P (90) | 3.39 | 0.04 | 820 | 99 |
| | HP2 Dist (90) | 3.33 | 0.14 | 803 | 99 |
| | Professional 100 | 3.70 | 0.30 | 780 | 93 |
| Maxfli | XF 100 | 4.45 | 0.27 | 780 | 90 |
| Bridgestone | Precept DW | 3.40 | 0.08 | 785 | 93 |

As shown by the results on Table 2, the balls of Example 1 had a lower frequency measurement based upon sound than all of the other balls that were tested.

Example 4

Golf Ball Mechanical Impedance and Natural Frequency Determinations

Mechanical impedance and natural frequency of the golf balls of the invention were determined, along with the mechanical impedance and natural frequency of commercially available golf balls.

Impedance was determined using a measurement of acceleration response over sine-sweep based frequencies.

Figure 9:
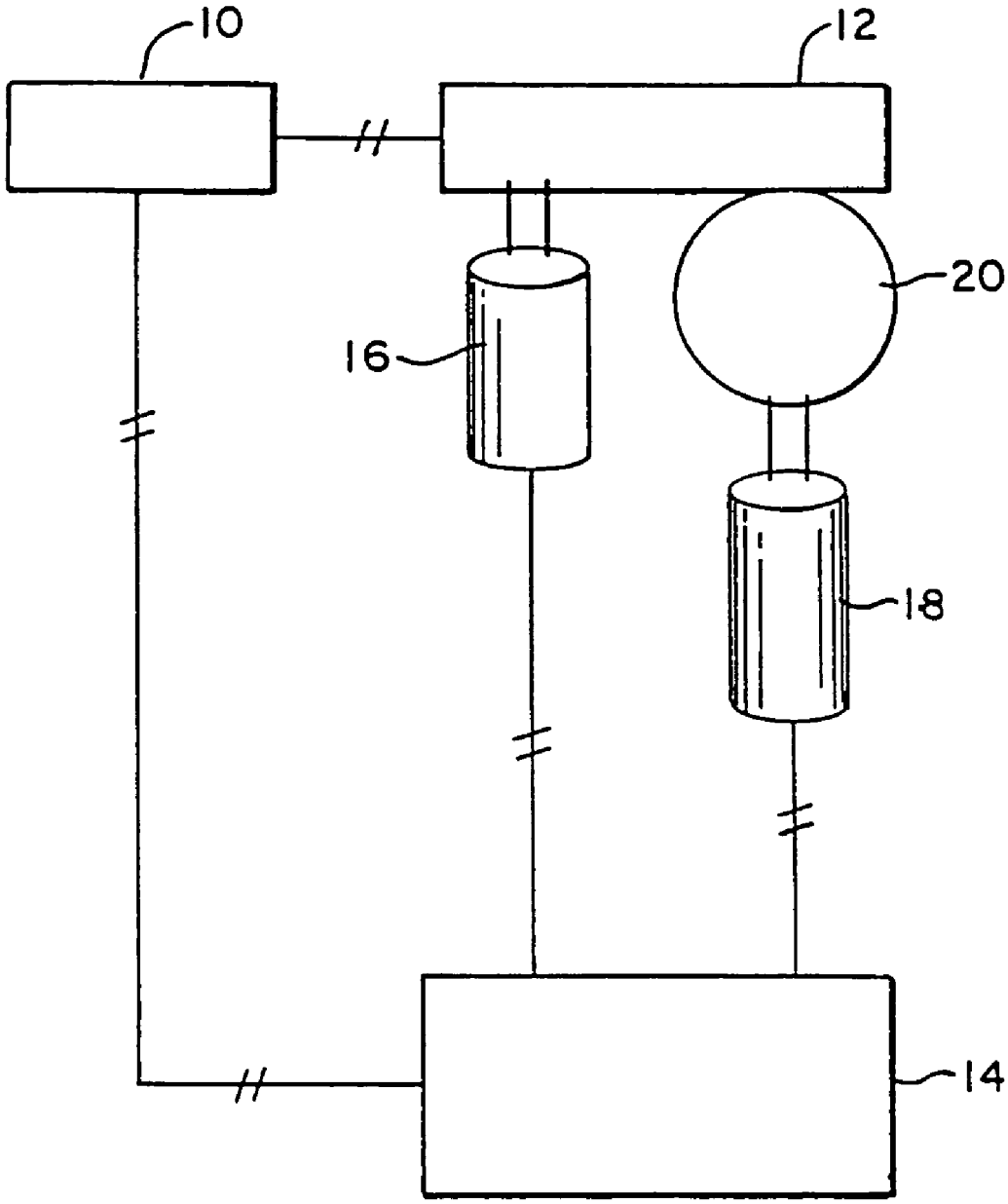
FIG. 9 schematically shows the equipment used to determine mechanical impedance of the golf balls of the present invention.

FIG. 9 schematically shows the equipment used to determine mechanical impedance of golf balls in accordance with the present invention. A power amplifier 10 (IMV Corp. PET-0A) was obtained and connected to a vibrator 12 (IMV Corp. PET-01). A dynamic signal analyzer 14 (Hewlett Packard 35670A) was obtained and connected to the amplifier 10 to provide a sine-sweep source to 10,000 Hz. An input accelerometer 16 (PCB Piezotronics, Inc., New York, A353B17) was physically connected to the vibrator 12 with Loctite 409 adhesive and electrically connected to the dynamic signal analyzer 14. The dynamic signal analyzer 14 was programmed such that it could calculate the mechanical impedance given two acceleration measurements and could plot this data over a frequency range.

An output accelerometer 18 (PCB Piezotronics, Inc., New York, A353B17) was obtained and electrically connected to the dynamic signal analyzer 14. A first golf ball sample 20 was obtained and bonded to the vibrator 12 using Loctite 409 adhesive. The output accelerometer 18 also was bonded to the ball using Loctite 409 adhesive. The vibrator 12 was turned on and a sweep was made from 100 to 10,000 Hz. Mechanical impedance was then plotted over this frequency range.

The natural frequency was determined by observing the frequency at which a second minimum occurred in the impedance curve. The first minimum value was determined to be a result of forced node resonance resulting from contact with the accelerometer 18 or the vibrator 12. This determination about the first minimum value is based upon separate tests which compared the above described mechanical impedance test method, referred to the "sine-sweep method" of determining mechanical impedance, as compared to an "impact method" in which a golf ball is suspended from a string and is contacted with an impact hammer on one side with accelerometer measurements taken opposite the impact hammer.

The mechanical impedance and natural frequency of the balls of Examples 1 and 2 above were determined using the above-described method. The first set of data was taken with the balls at room temperature. The second set of data was taken after the balls had been maintained at 21.1° C. (70° F.) for a period of time, preferably at least 15 hours. Furthermore, 12 commercially available golf balls also were tested. The results are shown below on Table 3.

TABLE 3

| BALL | NAT. FREQ. (Hz) | NAT. FREQ. 21.1° C. (Hz) | COR (×1000) | PGA COMP |
|---|---|---|---|---|
| Example 1 | 3070 | 2773 | 799 | 67 |
| Example 2 | 2773 | 2575 | 792 | 63 |
| Top-Flite | | | | |
| Strata Tour 90 | 3268 | 2674 | 772 | 92 |

TABLE 3-continued

| BALL | NAT. FREQ. (Hz) | NAT. FREQ. 21.1° C. (Hz) | COR (×1000) | PGA COMP |
|---|---|---|---|---|
| Magna Ex | 3268 | 3169 | | |
| Z Balata 90 | | 3268 | | |
| Titleist | | | | |
| Tour Balata 100 (wound) | 3070 | 2773 | 780 | 78 |
| Professional 100 (wound) | 3862 | | 780 | 93 |
| DT Wound 100 (wound) | 3664 | 2872 | | |
| HP2 Tour | 3763 | | 772 | 92 |
| Tour Balata 90 (wound) | | 2674 | | |
| Wilson | | | | |
| Staff Ti Baluta 100 | 3565 Hz | | 791 | 90 |
| Staff Ti Balata 90 | | 3466 | | |
| Ultra 500 Tour Balata | 3862 Hz | | | 100 |
| Bridgestone | | | | |
| Precept EV Extra Spin | 3664 Hz | | 785 | 93 |
| Precept Dynawing | 3466 Hz | | 803 | 87 |
| Maxfli | | | | |
| XF100 | 3763 Hz | | 780 | 90 |
| RM 100 (Is this correct?) | 3466 Hz | | 792 | 84 |
| Sumitomo | | | | |
| Srixon Hi-brid | | 2773 | | |

Additionally, a non-commercial, non-wound ball with a liquid (salt/sugar water) core was tested and was found to have a natural frequency of 3961.

As shown by the results on Table 3, the balls of the present invention have a low natural frequency in combination with a relatively high COR. The low natural frequency provides the balls with a soft sound and feel while maintaining good distance.

What is claimed is:

1. A golf ball comprising:

a solid core, wherein the core has a PGA compression of 55 or less;

a cover comprising an inner cover layer and an outer cover layer, wherein the inner cover layer comprises an ionomer resin and the outer cover layer comprises a polyurethane and wherein outer cover layer has a Shore D hardness of about 58 or more;

the ball having a PGA compression of 80 or less and a coefficient of restitution of at least 0.780.

2. The ball according to claim 1, wherein the ball has a PGA compression of 70 or less.

3. The ball according to claim 1, wherein the ball has a diameter of no more than 1.70 inches.

4. The ball according to claim 1, wherein the ball has a coefficient of restitution of at least 0.790.

5. The ball according to claim 1, wherein the ball has an outer cover hardness of 60 or more.

6. The ball according to claim 1, wherein the outer cover has a thickness of 0.01 to 0.20 inches.

7. The ball according to claim 1, wherein the outer cover has a thickness of 0.025 to 0.15 inches.

8. A golf ball according to claim 1, wherein the ball has a mechanical impedance with a primary minimum value in the frequency range of 3100 Hz or less after the ball has been maintained at 21.1° C., 1 atm. and about 50% relative humidity for at least 15 hours.

9. A golf ball comprising:

a solid polybutadiene core, wherein the core has a PGA compression of 55 or less;

an outer polyurethane cover layer having a Shore D hardness of about 58 or more;

the ball having a PGA compression of 80 or less and a coefficient of restitution of at least 0.780.

10. The ball according to claim 9, wherein the ball has a coefficient of restitution of at least 0.790.

11. The ball according to claim 9, wherein the ball has a mechanical impedance with a primary minimum value in the frequency range of 3100 Hz or less after the ball has been maintained at 21.1° C., 1 atm. and about 50% relative humidity for at least 15 hours.

12. The ball according to claim 9, wherein the outer cover has a thickness of 0.01 to 0.20 inches.

13. The ball according to claim 9, wherein the outer cover has a thickness of 0.025 to 0.15 inches.

14. A golf ball comprising:

a solid polybutadiene core, wherein the core has a PGA compression of 55 or less;

a cover comprising an inner cover layer and an outer cover layer, wherein the inner cover layer comprises an ionomer resin and the outer cover layer comprises a polyurethane and wherein outer cover layer has a Shore D hardness of about 58 or more;

the ball having a PGA compression of 80 or less and a coefficient of restitution of at least 0.780.

15. The ball according to claim 14, wherein the ball has a PGA compression of 70 or less.

16. The ball according to claim 14, wherein the ball has a diameter of no more than 1.70 inches.

17. The ball according to claim 14, wherein the ball has a coefficient of restitution of at least 0.790.

18. A golf ball according to claim 14, wherein the ball has a mechanical impedance with a primary minimum value in the frequency range of 3100 Hz or less after the ball has been maintained at 21.1° C., 1 atm. and about 50% relative humidity for at least 15 hours.

* * * * *